US007229151B2

(12) United States Patent
Silverbrook

(10) Patent No.: US 7,229,151 B2
(45) **Date of Patent: *Jun. 12, 2007**

(54) PRINTHEAD ASSEMBLY WITH MATING PRINTHEAD INTEGRATED CIRCUITS

(75) Inventor: Kia Silverbrook, Balmain (AU)

(73) Assignee: Silverbrook Research Pty Ltd, Balmain, NSW (AU)

( * ) Notice: Subject to any disclaimer, the term of this patent is extended or adjusted under 35 U.S.C. 154(b) by 0 days.

This patent is subject to a terminal disclaimer.

(21) Appl. No.: 11/271,917

(22) Filed: Nov. 14, 2005

(65) Prior Publication Data

US 2006/0061627 A1 Mar. 23, 2006

Related U.S. Application Data

(63) Continuation of application No. 10/943,901, filed on Sep. 20, 2004, now Pat. No. 6,994,421, which is a continuation of application No. 10/129,506, filed as application No. PCT/AU01/01515 on Nov. 22, 2001, now Pat. No. 6,843,551.

(30) Foreign Application Priority Data

Dec. 21, 2000 (AU) ..... PR2243

(51) Int. Cl.
*B41J 2/155* (2006.01)

(52) U.S. Cl. ..... 347/40; 347/59; 347/42

(58) Field of Classification Search ..... 347/42, 347/40, 59

See application file for complete search history.

(56) References Cited

U.S. PATENT DOCUMENTS

| | | | | |
|---|---|---|---|---|
| 6,428,141 | B1 | 8/2002 | McElfresh et al. | |
| 6,502,921 | B2 | 1/2003 | Kanda et al. | |
| 6,843,551 | B2 | 1/2005 | Silverbrook | |
| 2005/0225611 | A1 * | 10/2005 | Silverbrook | 347/85 |
| 2006/0008307 | A1 * | 1/2006 | Silverbrook | 400/77 |
| 2006/0017784 | A1 * | 1/2006 | Silverbrook | 347/59 |

FOREIGN PATENT DOCUMENTS

| | | | |
|---|---|---|---|
| DE | 19743804 | A1 | 4/1999 |
| EP | 0652107 | A | 5/1995 |
| EP | 0666174 | A2 | 8/1995 |
| EP | 0771657 | A | 5/1997 |
| EP | 0816085 | A | 1/1998 |
| JP | 11078013 | A | 3/1999 |
| WO | WO 01/42027 | A | 6/2001 |

* cited by examiner

*Primary Examiner*—Lamson Nguyen

(57) ABSTRACT

A printhead assembly includes an elongate ink distribution structure having ink inlets to receive ink and longitudinally extending ink channels in fluid communication with the inlets. An elongate ink duct assembly is mounted on the ink distribution structure and defines a plurality of converging ink ducts with inlets in fluid communication with the ink channels. A plurality of elongate and serially arranged printhead integrated circuits is mounted on the ink duct assembly to receive ink from the ink ducts. Each printhead integrated circuit defines mating formations on respective ends to facilitate mating of consecutive printhead integrated circuits.

7 Claims, 26 Drawing Sheets

PRINTHEAD ASSEMBLY WITH MATING PRINTHEAD INTEGRATED CIRCUITS

CROSS-REFERENCE TO RELATED APPLICATIONS

This is a Continuation application of U.S. application Ser. No. 10/943,901, filed on Sep. 20, 2004, now U.S. Pat. No. 6,994,421 which is a Continuation Application of U.S. application Ser. No. 10/129,506, filed on May 6, 2002, now issued as U.S. Pat. No. 6,843,551, which is a 371 of PCT/AU01/01515 filed on Nov. 22, 2001, the entire contents of which are herein incorporated by reference.

CO-PENDING APPLICATIONS

Various methods, systems and apparatus relating to the present invention are disclosed in the following co-pending US Patent Applications filed by the applicant or assignee of the present application on Jul. 10, 1998:

Ser. Nos. 09/112,751, 09/112,787, 09/112,802, 09/112,803, 09/113,097, 09/113,099, 09/113,084, 09/113,066, 09/112,778, 09/112,779, 09/113,077, 09/113,061, 09/112,818, 09/112,816, 09/112,772, 09/112,819, 09/112,815, 09/113,096, 09/113,068, 09/113,095, 09/112,808, 09/112,809, 09/112,780, 09/113,083, 09/113,121, 09/113,122, 09/112,793, 09/112,794, 09/113,128, 09/113,127, 09/112,756, 09/112,755, 09/112,754, 09/112,811, 09/112,812, 09/112,813, 09/112,814, 09/112,764, 09/112,765, 09/112,767, 09/112,768, 09/112,807, 09/112,806, 09/112,820, 09/112,821, 09/112,822, 09/112,825, 09/112,826, 09/112,827, 09/112,828, 09/113,108, 09/113,109, 09/113,123, 09/113,114, 09/113,115, 09/113,129, 09/113,124, 09/113,125, 09/113,126, 09/113,119, 09/113,120, 09/113,221, 09/113,116, 09/113,118, 09/113,117, 09/113,113, 09/113,130, 09/113,110, 09/113,112, 09/113,087, 09/113,074, 09/113,088 09/112,771, 09/112,769, 09/112,770, 09/112,817, 09/113,076, 09/112,798, 09/112,801, 09/112,800, 09/112,799, 09/113,098, 09/112,833, 09/112,832 09/112,831, 09/112,830, 09/112,836 and 09/112,835

The disclosures of these co-pending applications are incorporated herein by cross-reference.

Various methods, systems and apparatus relating to the present invention are disclosed in the following co-pending applications filed by the applicant or assignee of the present invention on May 23, 2000:

Ser. Nos. 09/575,197, 09/575,195, 09/575,159, 09/575,132, 09/575,123, 09/575,148, 09/575,130, 09/575,165, 09/575,153, 09/575,118, 09/575,131, 09/575,116, 09/575,144, 09/575,139, 09/575,186, 09/575,185, 09/575,191, 09/575,145, 09/575,192, 09/575,181, 09/575,193, 09/575,156, 09/575,183, 09/575,160, 09/575,150, 09/575,169, 09/575,184, 09/575,128, 09/575,180, 09/575,149, 09/575,179, 09/575,133, 09/575,143, 09/575,187, 09/575,155, 09/575,196, 09/575,198, 09/575,178, 09/575,164, 09/575,146, 09/575,174, 09/575,163, 09/575,168, 09/575,154, 09/575,129, 09/575,124, 09/575,188, 09/575,189, 09/575,162, 09/575,172, 09/575,170, 09/575,171, 09/575,161, 09/575,141, 09/575,125, 09/575,142, 09/575,140, 09/575,190, 09/575,138, 09/575,126, 09/575,127, 09/575,158, 09/575,117, 09/575,147, 09/575,152, 09/575,176, 09/575,151, 09/575,115, 09/575,114, 09/575,113, 09/575112, 09/575,111, 09/575,108, 09/575,109, 09/575,110, 09/607,985, 09/607,990, 09/607,196, 09/606,999, 09/609,140, 09/575,182, 09/575,194, 09/575,136, 09/575,119, 09/575,135, 09/575,157, 09/575,166, 09/575,134, 09/575,121, 09/575,137, 09/575,167, 09/575,120, and 09/575,122

The disclosures of these co-pending applications are incorporated herein by cross-reference.

BACKGROUND OF THE INVENTION

The following invention relates to an array of abutting printhead integrated circuits (or print 'chips' as they are commonly known) or printhead modules in a pagewidth printhead. More particularly, though not exclusively, the invention relates to an array of such abutting print chips for an A4 pagewidth ink jet drop on demand printhead capable of printing up to 160 dpi color photographic quality at up to 160 pages per minute.

The array of print chips in such a printhead would be approximately 8 inches (20 cm) long. An advantage of such a system is the ability to easily remove and replace any defective chips in the printhead array. This would eliminate having to scrap an entire printhead if only one chip is defective.

Our co-pending applications U.S. Ser. No. 09/575,115, Ser. No. 09/575,114, Ser. No. 09/575,113, Ser. No. 09/575,112 and Ser. No. 09/575,111, show a printhead module comprised of a "Memjet" chip, being a chip having mounted thereon a vast number of thermo-actuators in micro-mechanics and micro-electromechanical systems (MEMS). The present invention is a development of the arrangement of printhead modules as shown in the cross-referenced applications.

The printhead, which includes the array of printhead modules of the present invention might typically have six ink chambers and be capable of printing four color process (CMYK) as well as infra-red ink and fixative. An air pump would supply filtered air to the printhead, which could be used to keep foreign particles away from its ink nozzles. The printhead module is typically to be connected to a replaceable cassette which contains the ink supply and an air filter.

Each printhead module receives ink via a distribution molding that transfers the ink. Typically, ten modules butt together to form a complete eight inch printhead assembly suitable for printing A4 paper without the need for scanning movement of the printhead across the paper width.

The printheads themselves are modular, so complete eight inch printhead arrays can be configured to form printheads of arbitrary width.

Additionally, a second printhead assembly can be mounted on the opposite side of a paper feed path to enable double-sided high speed printing.

OBJECTS OF THE INVENTION

It is an object of the present invention to provide an array of abutting printhead modules in a pagewidth printer.

It is another object of the present invention to provide an array of abutting printhead modules suitable for the pagewidth printhead as broadly described herein.

It is another object of the present invention to provide an array of abutting printhead modules each comprising print chips having a plurality of MEMS printing devices thereon.

SUMMARY OF THE INVENTION

There is disclosed herein a print chip for assembly into an array of abutting integrated circuits in a printhead of an ink jet printer, the integrated circuit including rows of unit cells, each unit cell having an ink ejection nozzle, said integrated circuit having an end surface for abutting with another integrated circuit of the array, said end surface including features of shape to cooperate with corresponding features of shape of an end surface of said another integrated circuit to ensure that a desired positional relationship between the ink ejection nozzles of said integrated circuit and said another integrated circuit is maintained in use.

Preferably the unit cells of each row are positioned such that the ink ejection nozzles is equally spaced along the row.

Preferably the features of shape of the end surfaces include a zig-zag formation.

Preferably the integrated circuit includes twelve rows of unit cells.

Preferably the twelve rows of unit cells are made up of six pairs of rows, each pair printing ink of one color.

There is further disclosed herein an array of abutting integrated circuits in a printhead of an ink jet printer, each integrated circuit being as disclosed above.

Preferably the pair of unit cells rows dedicated to one color in one integrated circuit is longitudinally aligned with a pair of unit cell rows of an adjoining integrated circuit printing a different color.

Preferably there is a dimension between end-most nozzles across the abutting end surfaces that is equivalent to double a dimension between the nozzles along any row of one of the integrated circuit.

Preferably the zigzag formation includes a sequence of angled portions and a sequence of aligned longitudinal portions interspersed therewith.

As used herein, the term "ink" is intended to mean any fluid which flows through the printhead to be delivered to a sheet. The fluid may be one of many different colored inks, infrared ink, a fixative or the like.

BRIEF DESCRIPTION OF THE DRAWINGS

Preferred forms of the present invention will now be described by way of example with reference to the accompanying drawings wherein.

DETAILED DESCRIPTION OF THE INVENTION

Figure 1:
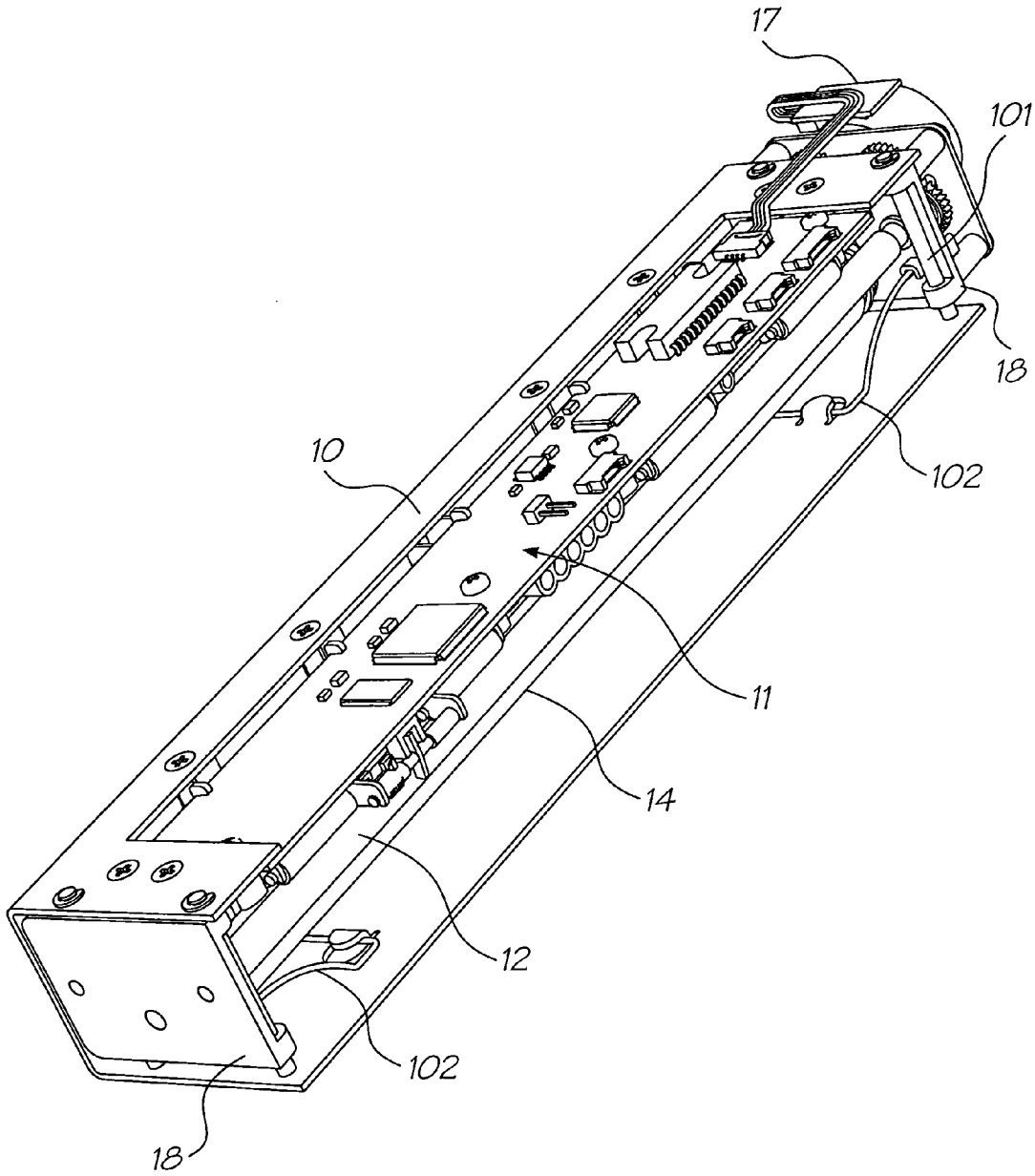
FIG. 1 is a front perspective view of a print engine assembly.
Figure 2:
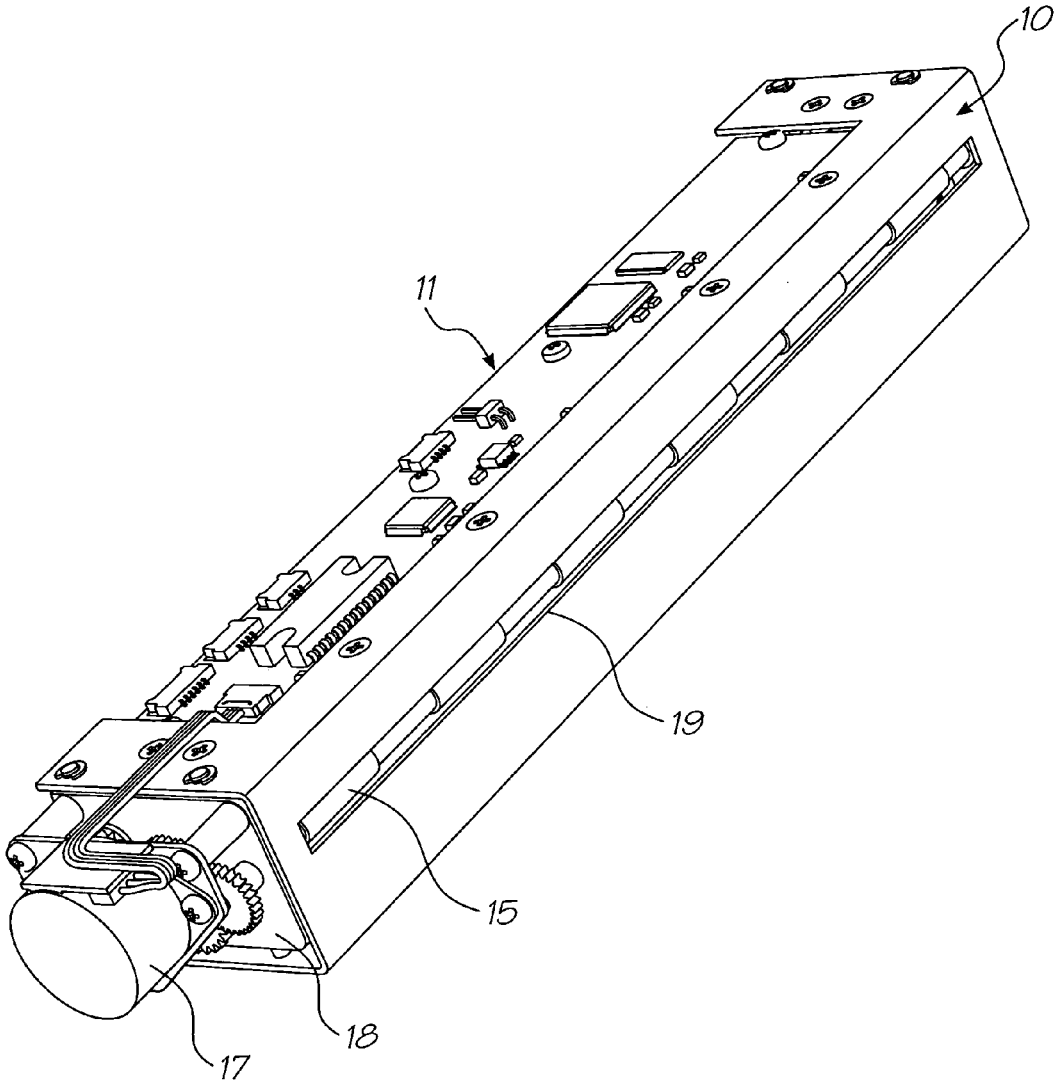
FIG. 2 is a rear perspective view of the print engine assembly of FIG. 1.
Figure 3:
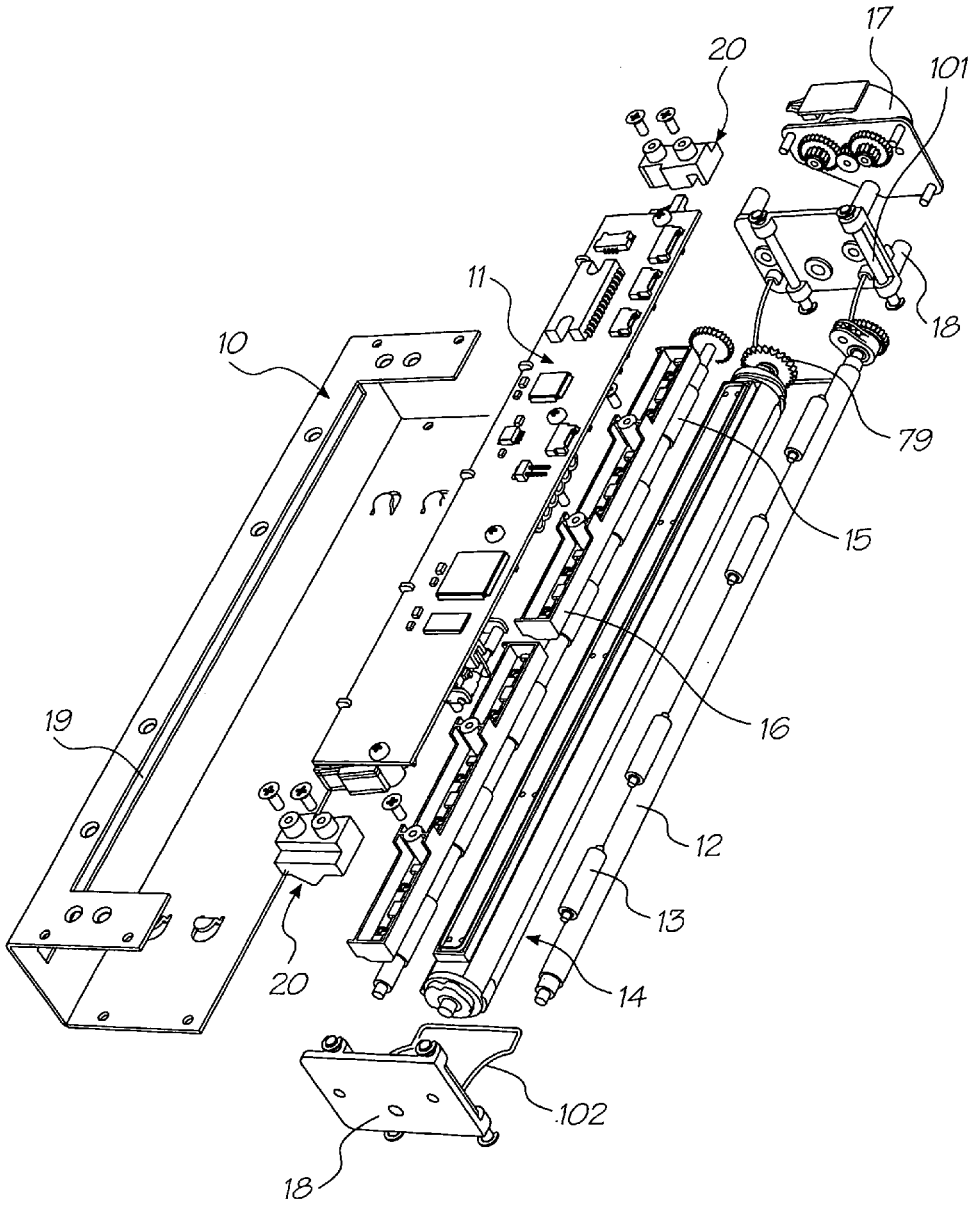
FIG. 3 is an exploded perspective view of the print engine assembly of FIG. 1.
Figure 4:
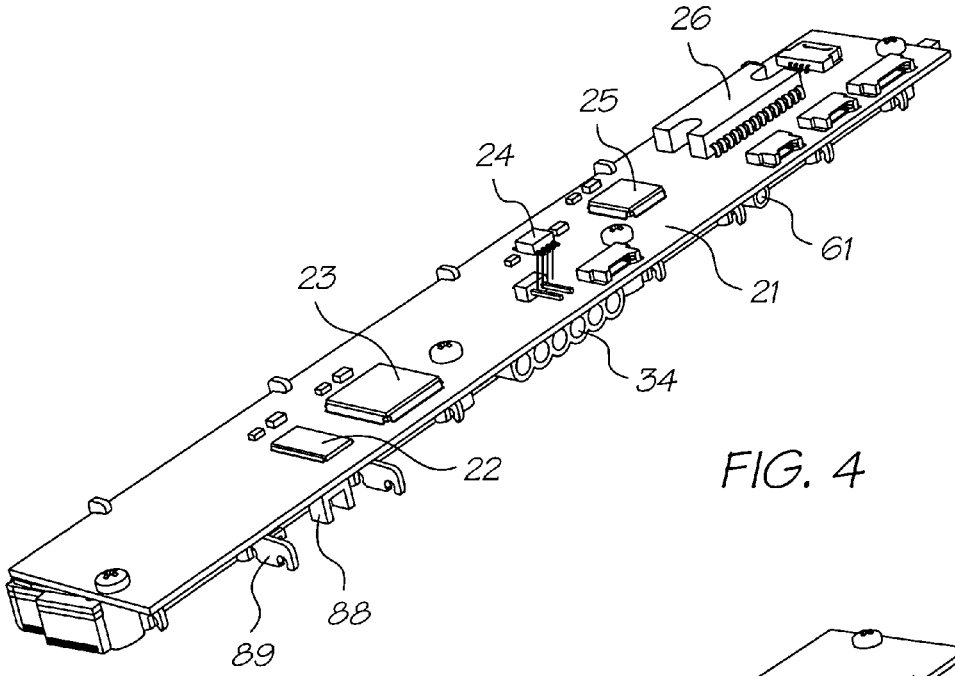
FIG. 4 is a schematic front perspective view of a printhead assembly.
Figure 5:
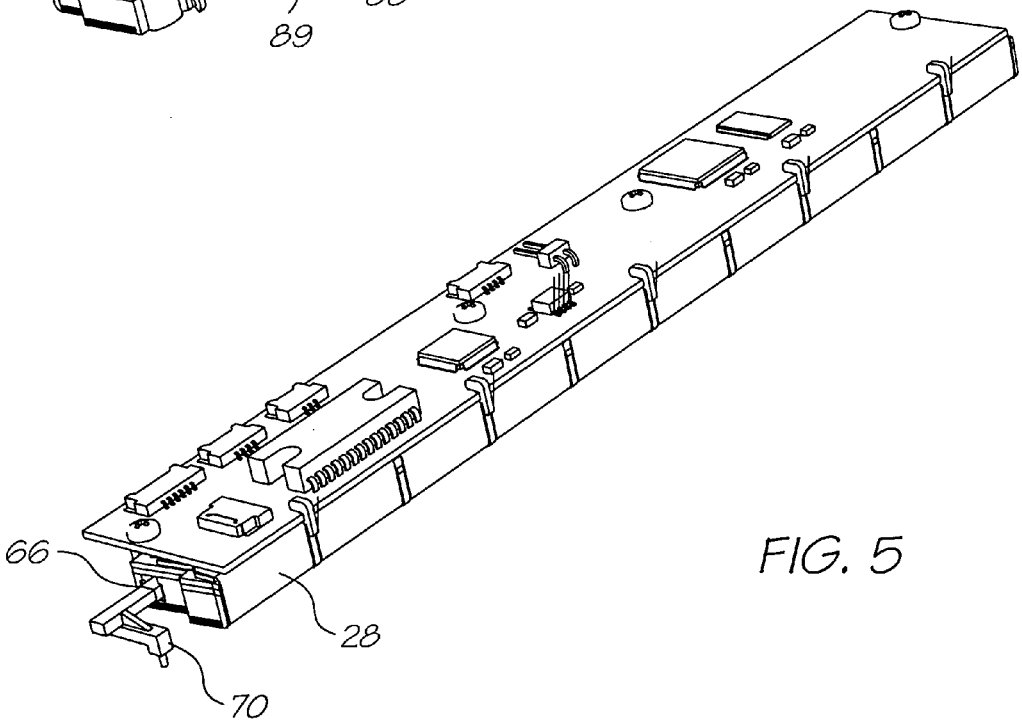
FIG. 5 is a rear schematic perspective view of the printhead assembly of FIG. 4.

In FIGS. 1 to 3 of the accompanying drawings there is schematically depicted the core components of a print engine assembly, showing the general environment in which the laminated ink distribution structure of the present invention can be located. The print engine assembly includes a chassis 10 fabricated from pressed steel, aluminum, plastics or other rigid material. Chassis 10 is intended to be mounted within the body of a printer and serves to mount a printhead assembly 11, a paper feed mechanism and other related components within the external plastics casing of a printer.

In general terms, the chassis 10 supports the printhead assembly 11 such that ink is ejected therefrom and onto a sheet of paper or other print medium being transported below the printhead then through exit slot 19 by the feed mechanism. The paper feed mechanism includes a feed roller 12, feed idler rollers 13, a platen generally designated as 14, exit rollers 15 and a pin wheel assembly 16, all driven by a stepper motor 17. These paper feed components are mounted between a pair of bearing moldings 18, which are in turn mounted to the chassis 10 at each respective end thereof.

A printhead assembly 11 is mounted to the chassis 10 by means of respective printhead spacers 20 mounted to the chassis 10. The spacer moldings 20 increase the printhead assembly length to 220 mm allowing clearance on either side of 210 mm wide paper.

The printhead construction is shown generally in FIGS. 4 to 8.

Figure 12:
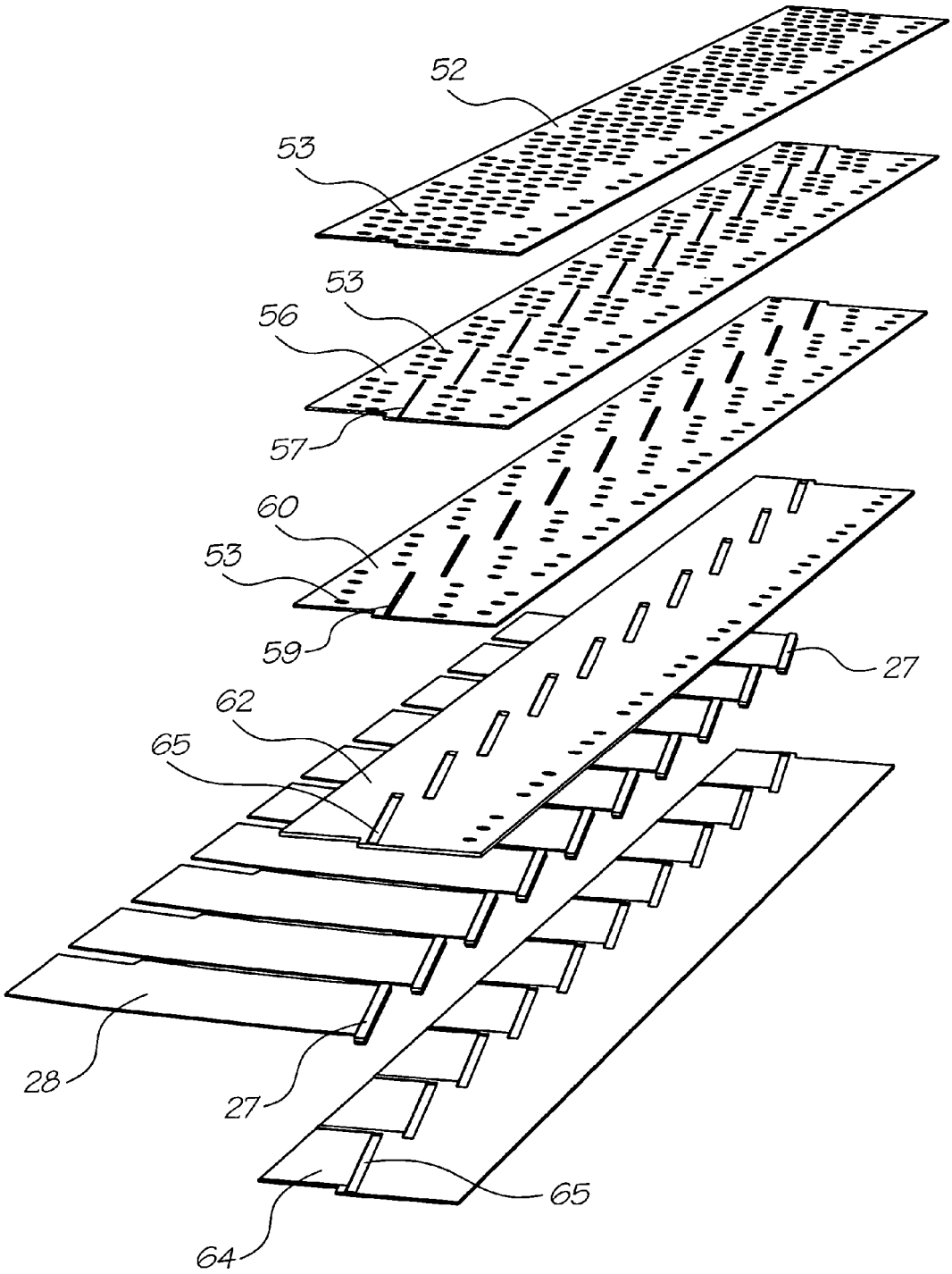
FIG. 12 is an exploded perspective illustration showing the layers forming part of a laminated ink distribution structure according to the present invention.

The printhead assembly 11 includes a printed circuit board (PCB) 21 having mounted thereon various electronic components including a 64 MB DRAM 22, a PEC chip 23, a QA chip connector 24, a microcontroller 25, and a dual motor driver chip 26. The printhead is typically 203 mm long and has ten integrated circuits 27, or 'print chips' as they are informally known in the industry, (FIG. 13), each typically 21 mm long. These print chips 27 are each disposed at a slight angle to the longitudinal axis of the printhead (see FIG. 12), with a slight overlap between each print chip which enables continuous transmission of ink over the entire length of the array. Each print chip 27 is electronically connected to an end of one of the tape automated bond (TAB) films 28, the other end of which is maintained in electrical contact with the undersurface of the printed circuit board 21 by means of a TAB film backing pad 29.

The preferred print chip construction is as described in U.S. Pat. No. 6,044,646 by the present applicant. Each such print chip 27 is approximately 21 mm long, less than 1 mm wide and about 0.3 mm high, and has on its lower surface thousands of MEMS inkjet nozzles 30, shown schematically in FIGS. 9A and 9B, arranged generally in six lines—one for each ink type to be applied. Each line of nozzles may follow a staggered pattern to allow closer dot spacing. Six corresponding lines of ink passages 31 extend through from the rear of the print chip to transport ink to the rear of each nozzle. To protect the delicate nozzles on the surface of the print chip each print chip has a nozzle guard 43, best seen in FIG. 9A, with microapertures 44 aligned with the nozzles 30, so that the ink drops ejected at high speed from the nozzles pass through these microapertures to be deposited on the paper passing over the platen 14.

Ink is delivered to the print chips via a distribution molding 35 and laminated stack 36 arrangement forming part of the printhead 11. Ink from an ink cassette 37 (FIGS. 26 and 27) is relayed via individual ink hoses 38 to individual ink inlet ports 34 integrally molded with a plastics duct cover 39 which forms a lid over the plastics distribution molding 35. The distribution molding 35 includes six individual longitudinal ink ducts 40 and an air duct 41 which extend throughout the length of the array. Ink is transferred from the inlet ports 34 to respective ink ducts 40 via individual cross-flow ink channels 42, as best seen with reference to FIG. 7. It should be noted in this regard that although there are six ducts depicted, a different number of ducts might be provided. Six ducts are suitable for a printer capable of printing four-color process (CMYK) as well as infra-red ink and fixative.

Air is delivered to the air duct 41 via an air inlet port 61, to supply air to each print chip 27, as described later with reference to FIGS. 6 to 8, 20 and 21.

Situated within a longitudinally extending stack recess 45 formed in the underside of distribution molding 35 are a number of laminated layers forming a laminated ink distribution stack 36. The layers of the laminate are typically formed of micro-molded plastics material. The TAB film 28 extends from the undersurface of the printhead PCB 21, around the rear of the distribution molding 35 to be received within a respective TAB film recess 46 (FIG. 21), a number of which are situated along a chip housing layer 47 of the laminated stack 36. The TAB film relays electrical signals from the printed circuit board 21 to individual print chips 27 supported by the laminated structure.

The distribution molding, laminated stack 36 and associated components are best described with reference to FIGS. 7 to 19.

Figure 10:
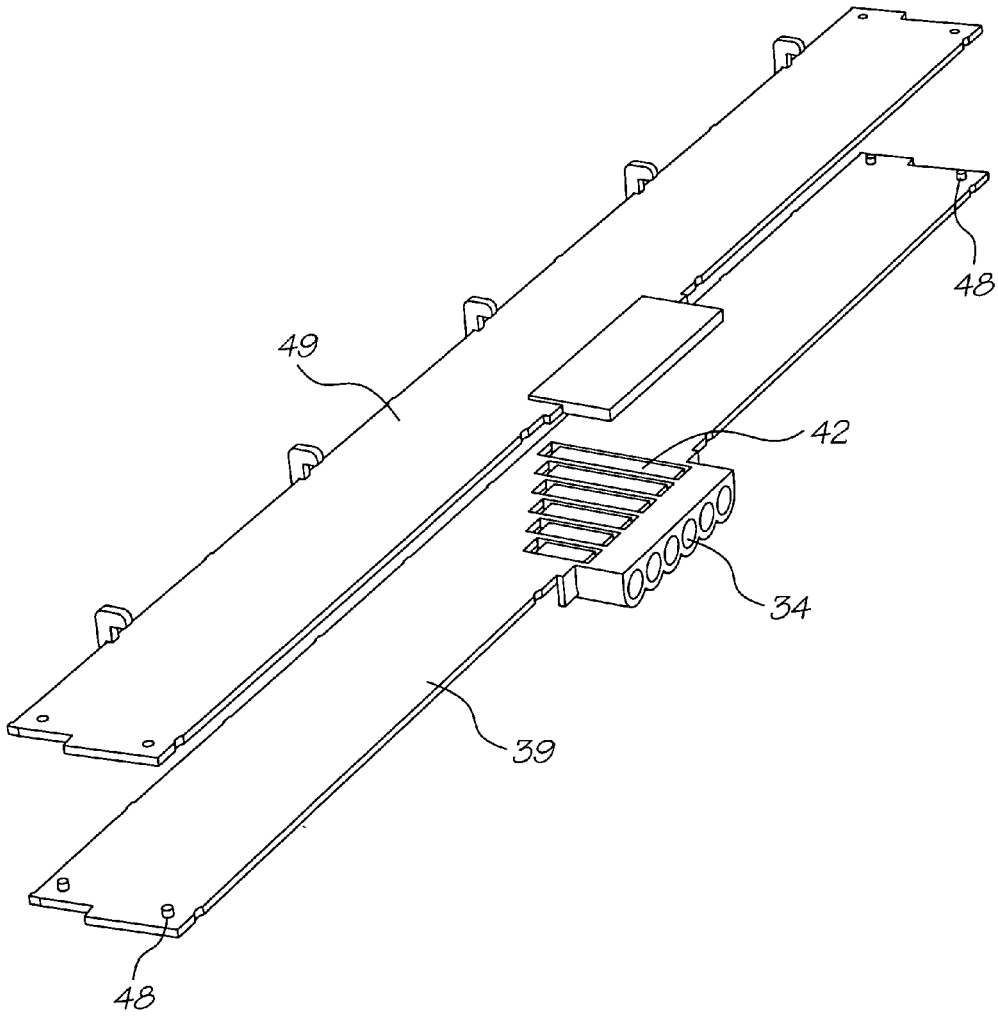
FIG. 10 is an exploded perspective illustration of a printhead cover assembly.
Figure 11:
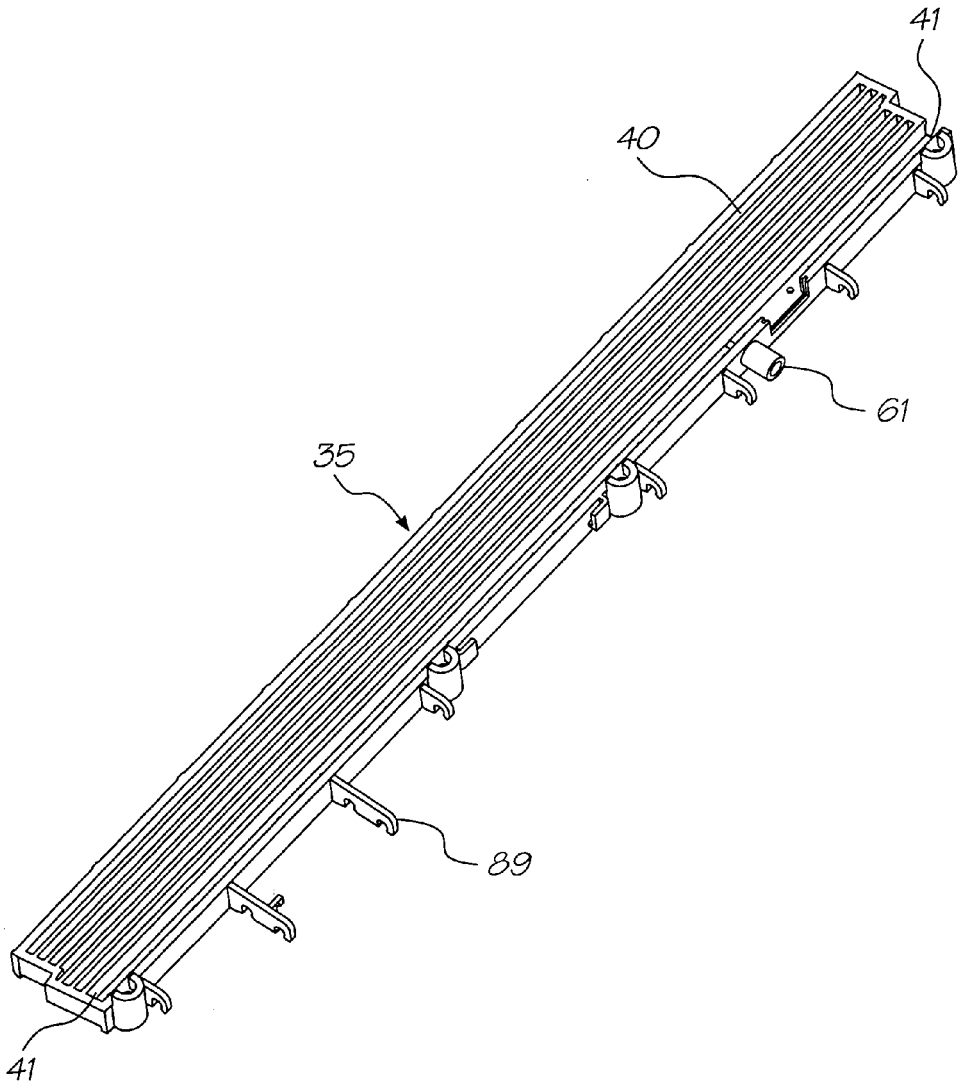
FIG. 11 is a schematic perspective illustration of an ink distribution molding.

FIG. 10 depicts the distribution molding cover 39 formed as a plastics molding and including a number of positioning spigots 48 which serve to locate the upper printhead cover 49 thereon.

Figure 7:
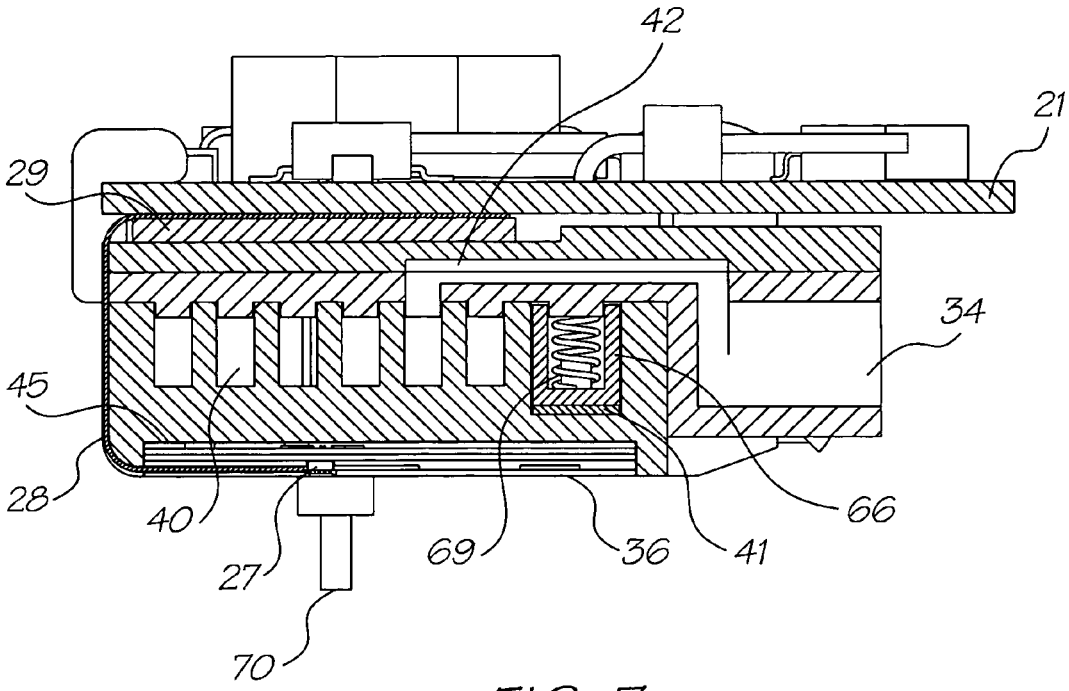
FIG. 7 is a cross-sectional end elevational view of the printhead assembly of FIGS. 4 to 6 with the section taken through the centre of the printhead.

As shown in FIG. 7, an ink transfer port 50 connects one of the ink ducts 39 (the fourth duct from the left) down to one of six lower ink ducts or transitional ducts 51 in the underside of the distribution molding. All of the ink ducts 40 have corresponding transfer ports 50 communicating with respective ones of the transitional ducts 51. The transitional ducts 51 are parallel with each other but angled acutely with respect to the ink ducts 40 so as to line up with the rows of ink holes of the first layer 52 of the laminated stack 36 to be described below.

The first layer 52 incorporates twenty four individual ink holes 53 for each of ten print chips 27. That is, where ten such print chips are provided, the first layer 52 includes two hundred and forty ink holes 53. The first layer 52 also includes a row of air holes 54 alongside one longitudinal edge thereof.

The individual groups of twenty four ink holes 53 are formed generally in a rectangular array with aligned rows of ink holes. Each row of four ink holes is aligned with a transitional duct 51 and is parallel to a respective print chip.

The undersurface of the first layer 52 includes underside recesses 55. Each recess 55 communicates with one of the ink holes of the two centre-most rows of four holes 53 (considered in the direction transversely across the layer 52). That is, holes 53*a* (FIG. 13) deliver ink to the right hand recess 55*a* shown in FIG. 14, whereas the holes 53*b* deliver ink to the left most underside recesses 55*b* shown in FIG. 14.

The second layer 56 includes a pair of slots 57, each receiving ink from one of the underside recesses 55 of the first layer.

The second layer 56 also includes ink holes 53 which are aligned with the outer two sets of ink holes 53 of the first layer 52. That is, ink passing through the outer sixteen ink holes 53 of the first layer 52 for each print chip pass directly through corresponding holes 53 passing through the second layer 56.

The underside of the second layer 56 has formed therein a number of transversely extending channels 58 to relay ink passing through ink holes 53*c* and 53*d* toward the centre. These channels extend to align with a pair of slots 59 formed through a third layer 60 of the laminate. It should be noted in this regard that the third layer 60 of the laminate includes four slots 59 corresponding with each print chip, with two inner slots being aligned with the pair of slots formed in the second layer 56 and outer slots between which the inner slots reside.

The third layer 60 also includes an array of air holes 54 aligned with the corresponding air hole arrays 54 provided in the first and second layers 52 and 56.

Figure 9A:
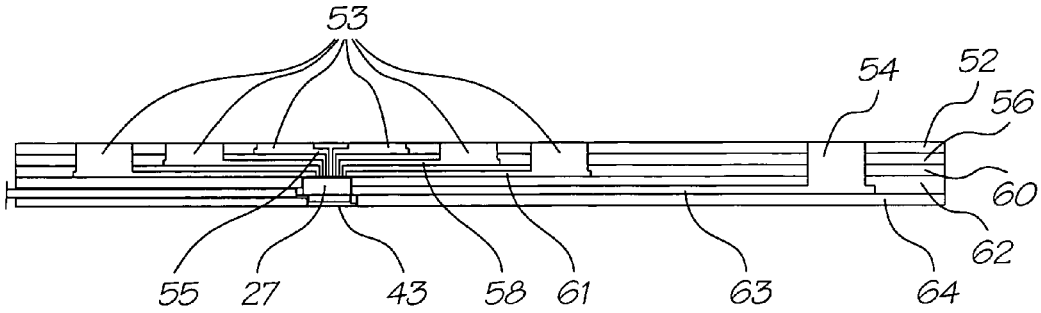
FIG. 9A is a schematic end elevational view of mounting of the print chip and nozzle guard in the laminated stack structure of the printhead.
Figure 9B:
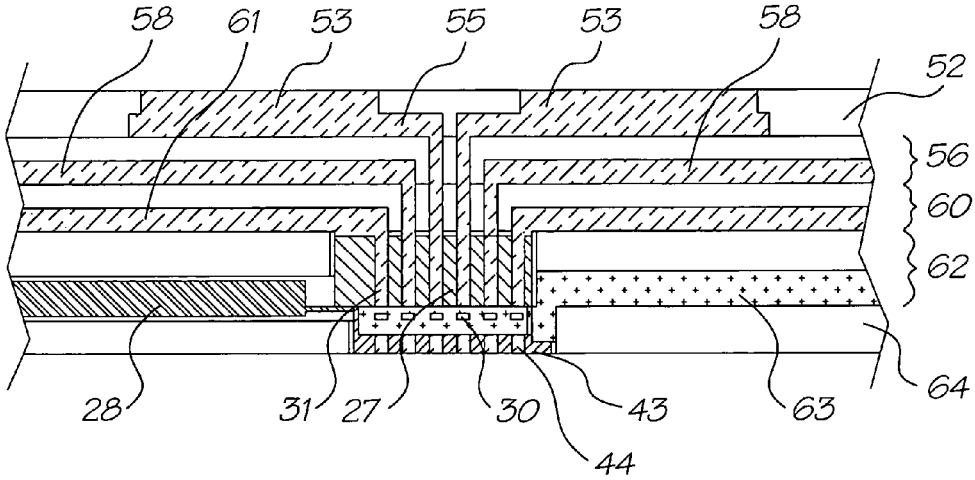
FIG. 9B is an enlarged end elevational cross section of FIG. 9A.

The third layer 60 has only eight remaining ink holes 53 corresponding with each print chip. These outermost holes 53 are aligned with the outermost holes 53 provided in the first and second laminate layers. As shown in FIGS. 9A and 9B, the third layer 60 includes in its underside surface a transversely extending channel 61 corresponding to each hole 53. These channels 61 deliver ink from the corresponding hole 53 to a position just outside the alignment of slots 59 therethrough.

As best seen in FIGS. 9A and 9B, the top three layers of the laminated stack 36 thus serve to direct the ink (shown by broken hatched lines in FIG. 9B) from the more widely spaced ink ducts 40 of the distribution molding to slots aligned with the ink passages 31 through the upper surface of each print chip 27.

Figure 13:
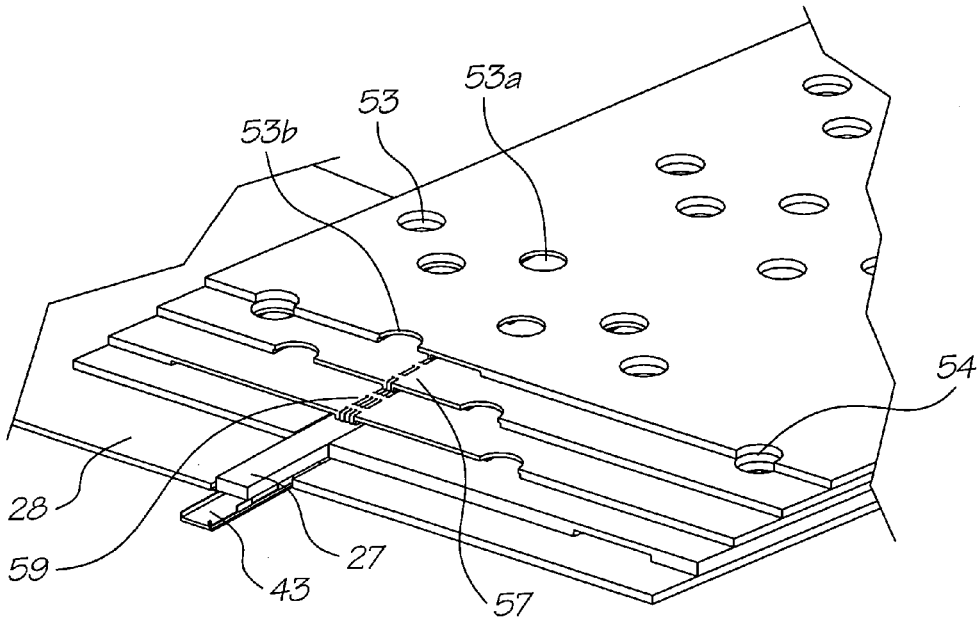
FIG. 13 is a stepped sectional view from above of the structure depicted in FIGS. 9A and 9B.
Figure 14:
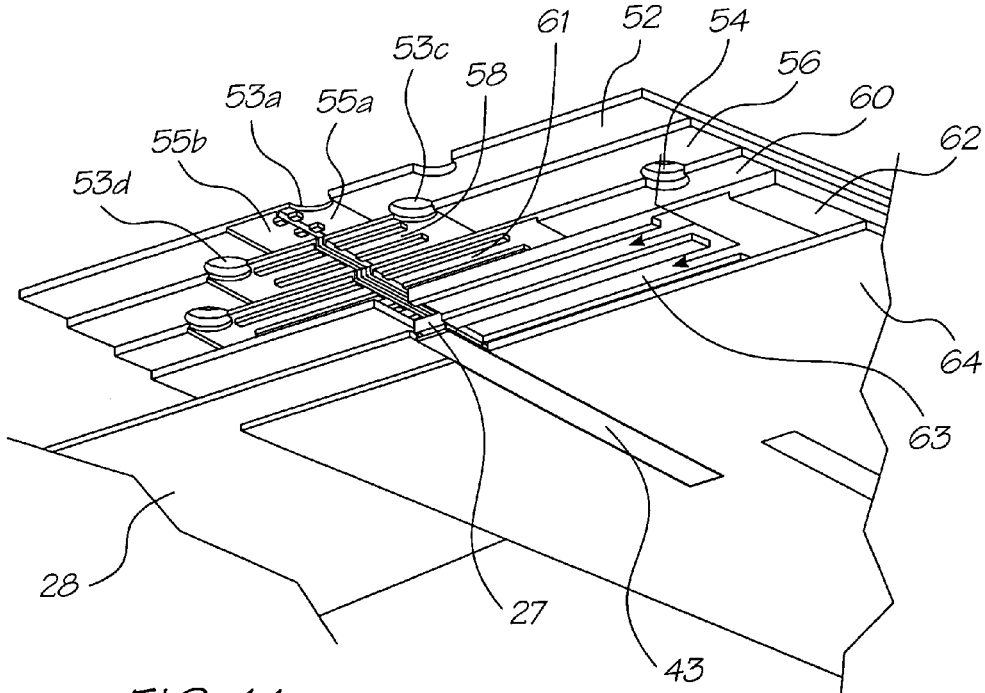
FIG. 14 is a stepped sectional view from below of the structure depicted in FIG. 13.
Figure 15:
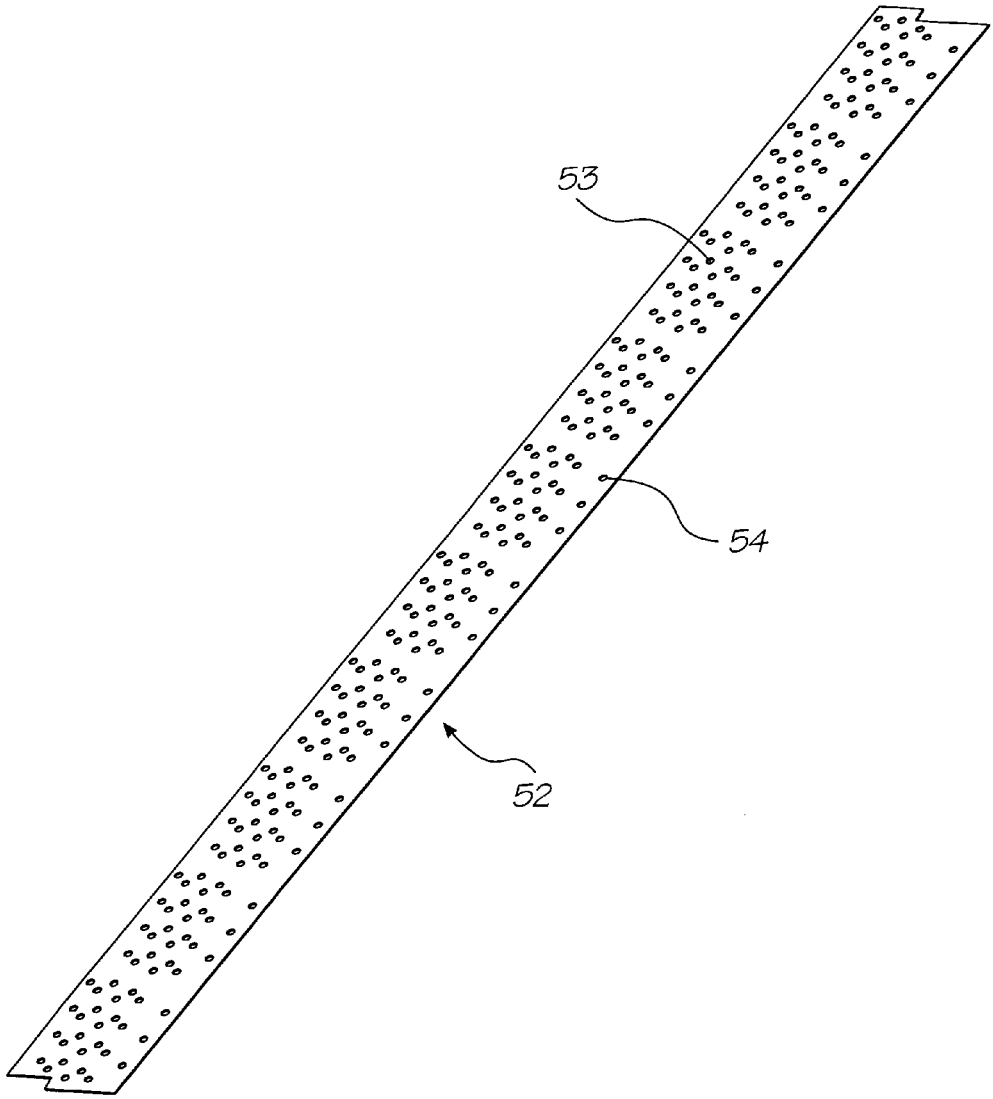
FIG. 15 is a schematic perspective illustration of a first laminate layer.
Figure 16:
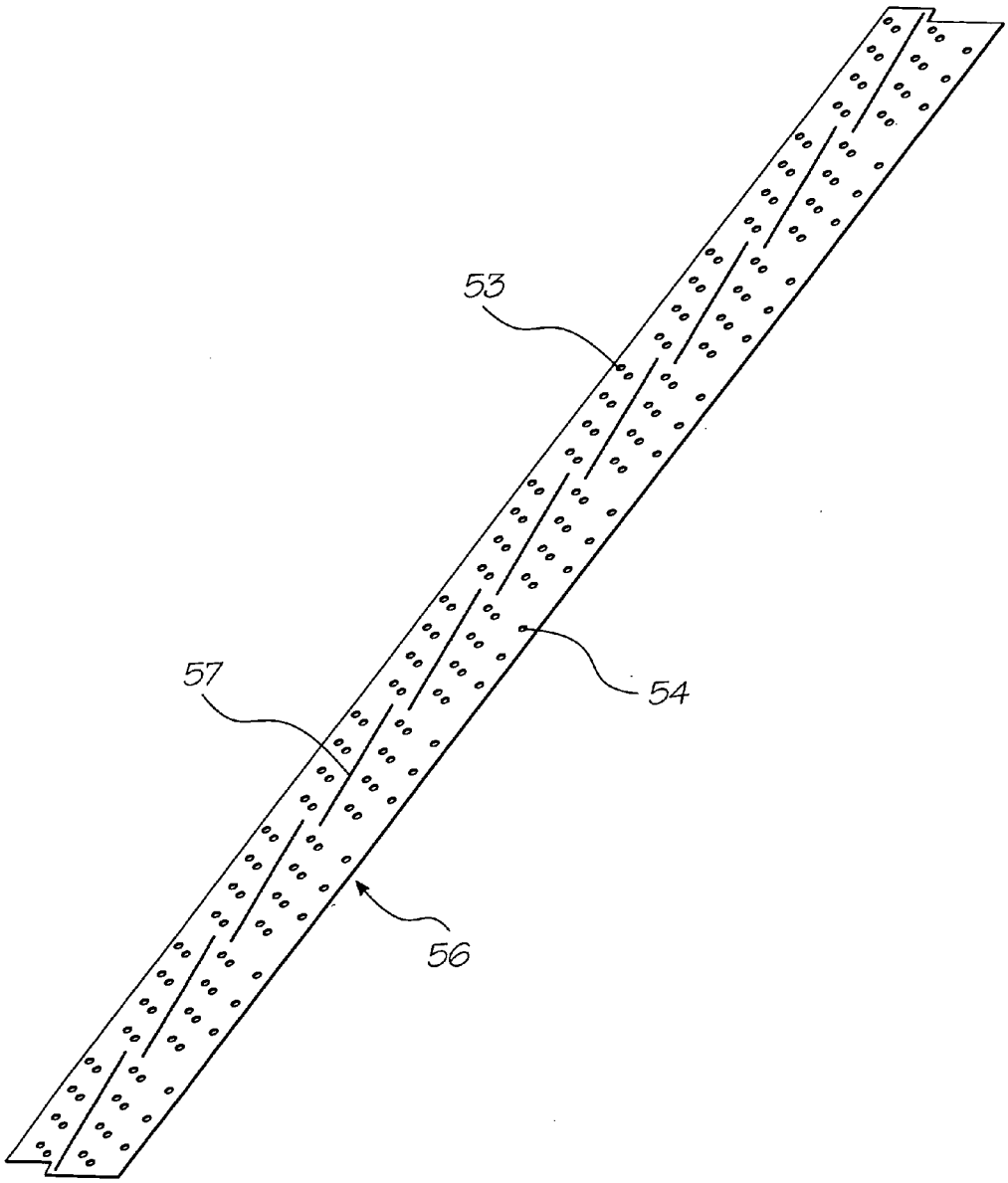
FIG. 16 is a schematic perspective illustration of a second laminate layer.
Figure 17:
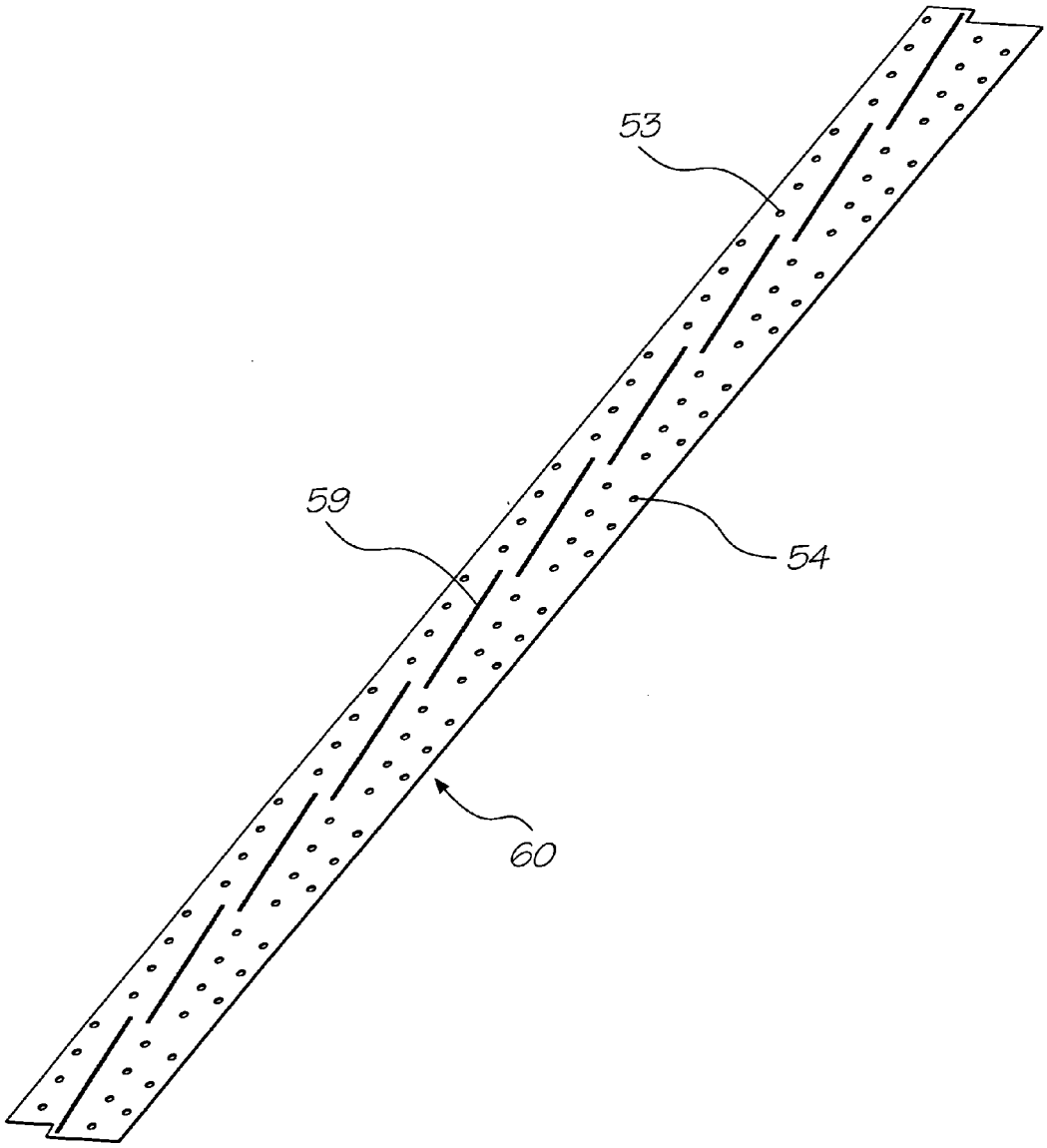
FIG. 17 is a schematic perspective illustration of a third laminate layer.
Figure 18:
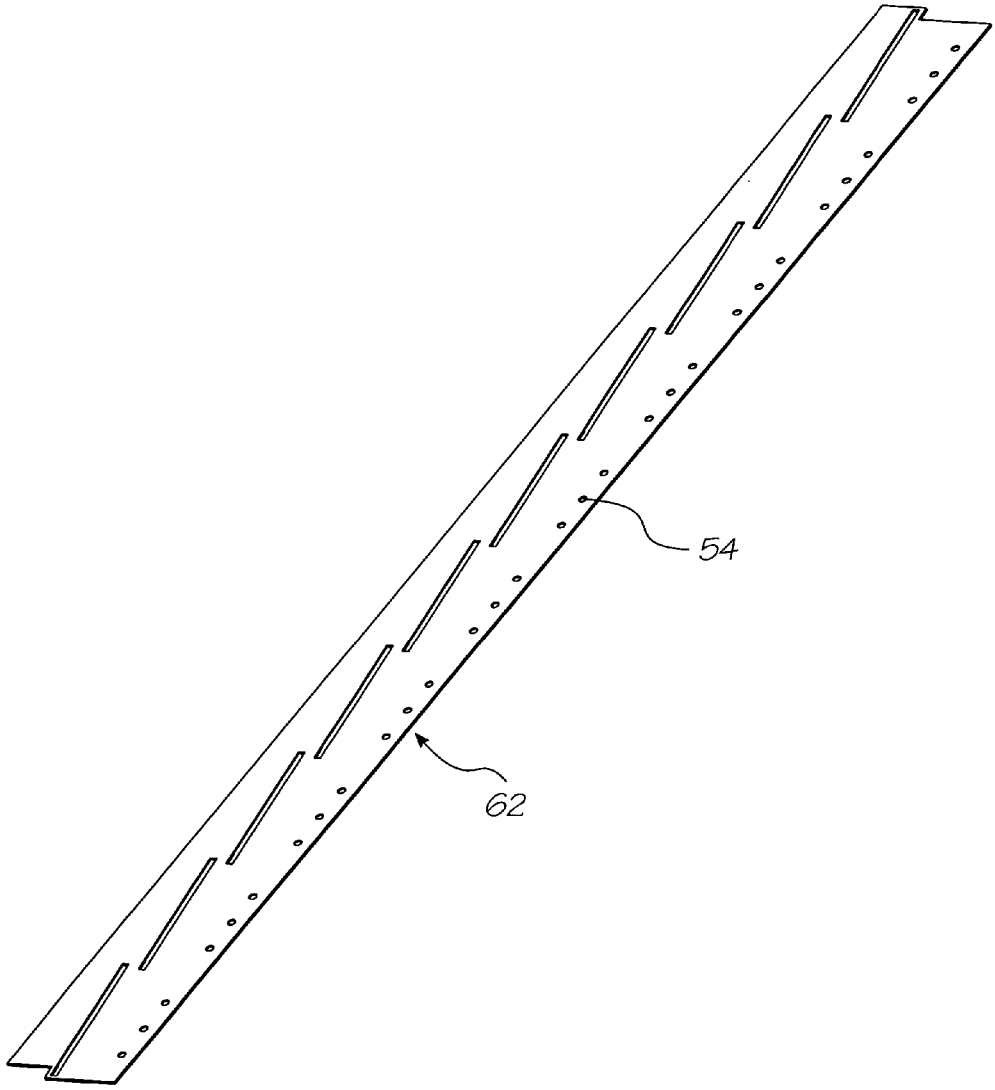
FIG. 18 is a schematic perspective illustration of a fourth laminate layer.
Figure 19:
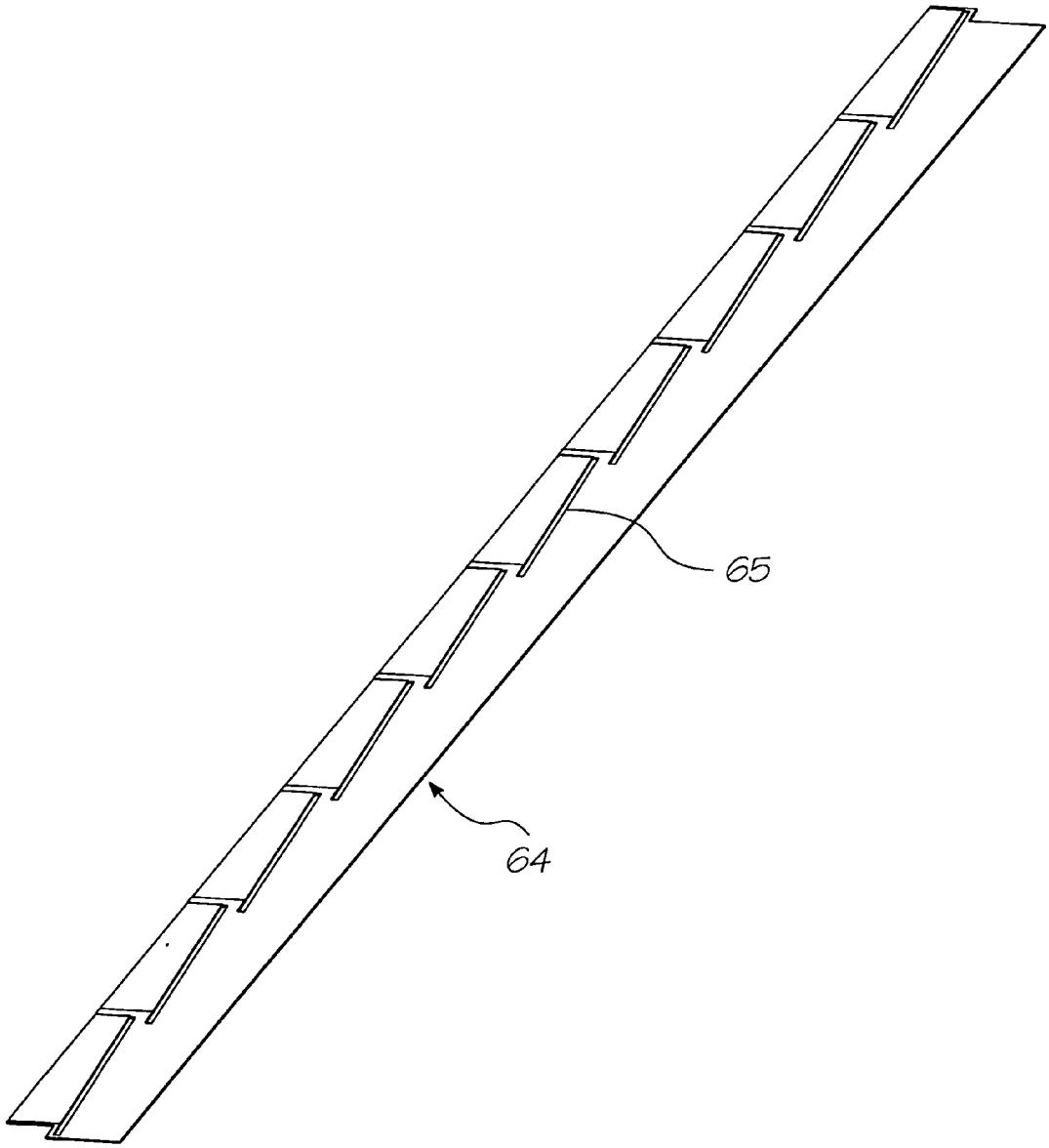
FIG. 19 is a schematic perspective illustration of a fifth laminate layer.
Figure 20:
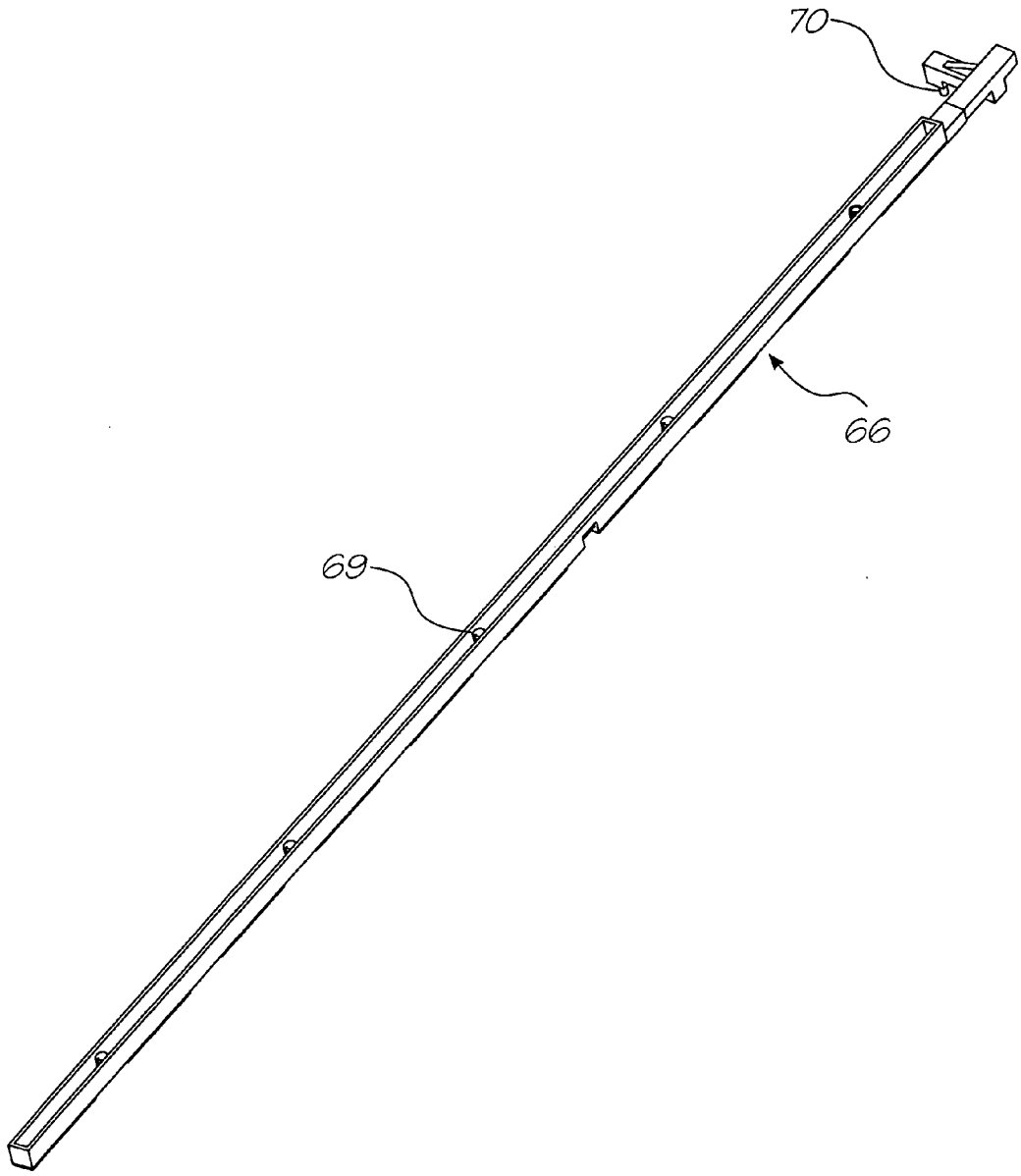
FIG. 20 is a perspective view of the air valve molding.
Figure 22:
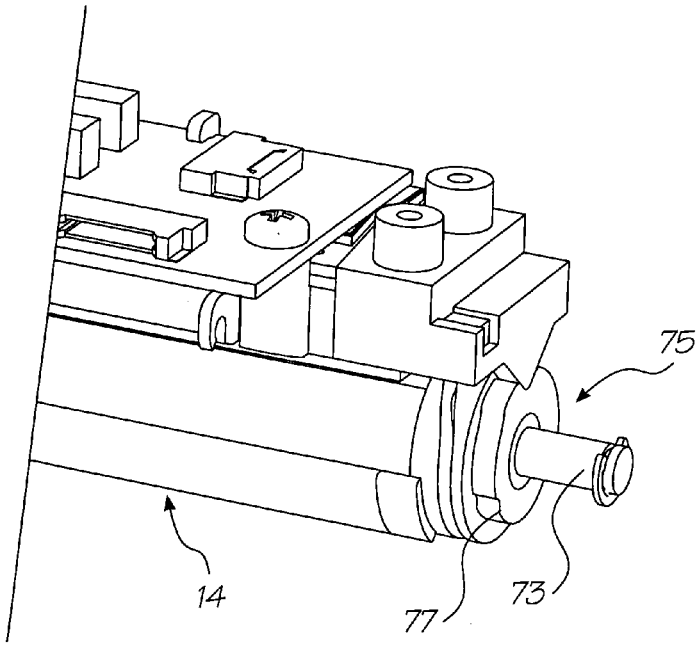
FIG. 22 is a rear perspective view of the left hand end of the platen.
Figure 21:
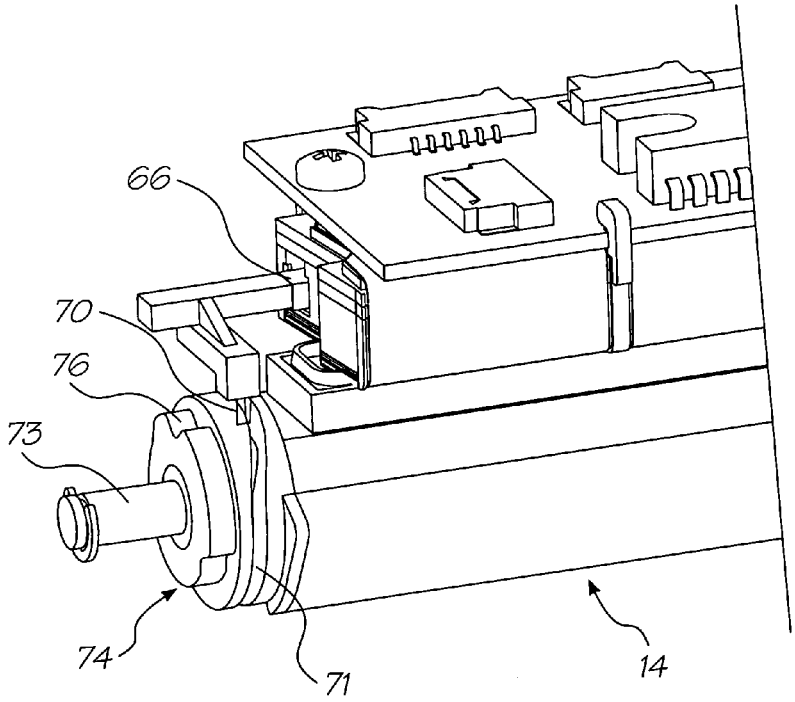
FIG. 21 is a rear perspective view of the right hand end of the platen.

As shown in FIG. 13, which is a view from above the laminated stack, the slots 57 and 59 can in fact be comprised of discrete co-linear spaced slot segments.

The fourth layer 62 of the laminated stack 36 includes an array of ten chip-slots 65 each receiving the upper portion of a respective print chip 27.

The fifth and final layer 64 also includes an array of chip-slots 65 which receive the chip and nozzle guard assembly 43.

The TAB film 28 is sandwiched between the fourth and fifth layers 62 and 64, one or both of which can be provided with recesses to accommodate the thickness of the TAB film.

The laminated stack is formed as a precision micro-molding, injection molded in an Acetal type material. It accommodates the array of print chips 27 with the TAB film already attached and mates with the cover molding 39 described earlier.

Rib details in the underside of the micro-molding provides support for the TAB film when they are bonded together. The TAB film forms the underside wall of the printhead module, as there is sufficient structural integrity between the pitch of the ribs to support a flexible film. The edges of the TAB film seal on the underside wall of the cover molding 39. The chip is bonded onto one hundred micron wide ribs that run the length of the micro-molding, providing a final ink feed to the print nozzles.

The design of the micro-molding allow for a physical overlap of the print chips when they are butted in a line. Because the printhead chips now form a continuous strip with a generous tolerance, they can be adjusted digitally to produce a near perfect print pattern rather than relying on very close toleranced moldings and exotic materials to perform the same function. The pitch of the modules is typically 20.33 mm.

The individual layers of the laminated stack as well as the cover molding 39 and distribution molding can be glued or otherwise bonded together to provide a sealed unit. The ink paths can be sealed by a bonded transparent plastic film serving to indicate when inks are in the ink paths, so they can be fully capped off when the upper part of the adhesive film is folded over. Ink charging is then complete.

The four upper layers 52, 56, 60, 62 of the laminated stack 36 have aligned air holes 54 which communicate with air passages 63 formed as channels formed in the bottom surface of the fourth layer 62, as shown in FIGS. 9*b* and 13. These passages provide pressurised air to the space between the print chip surface and the nozzle guard 43 whilst the printer is in operation. Air from this pressurised zone passes through the micro-apertures 44 in the nozzle guard, thus preventing the build-up of any dust or unwanted contaminants at those apertures. This supply of pressurised air can be turned off to prevent ink drying on the nozzle surfaces during periods of non-use of the printer, control of this air supply being by means of the air valve assembly shown in FIGS. 6 to 8, 20 and 21.

Figure 6:
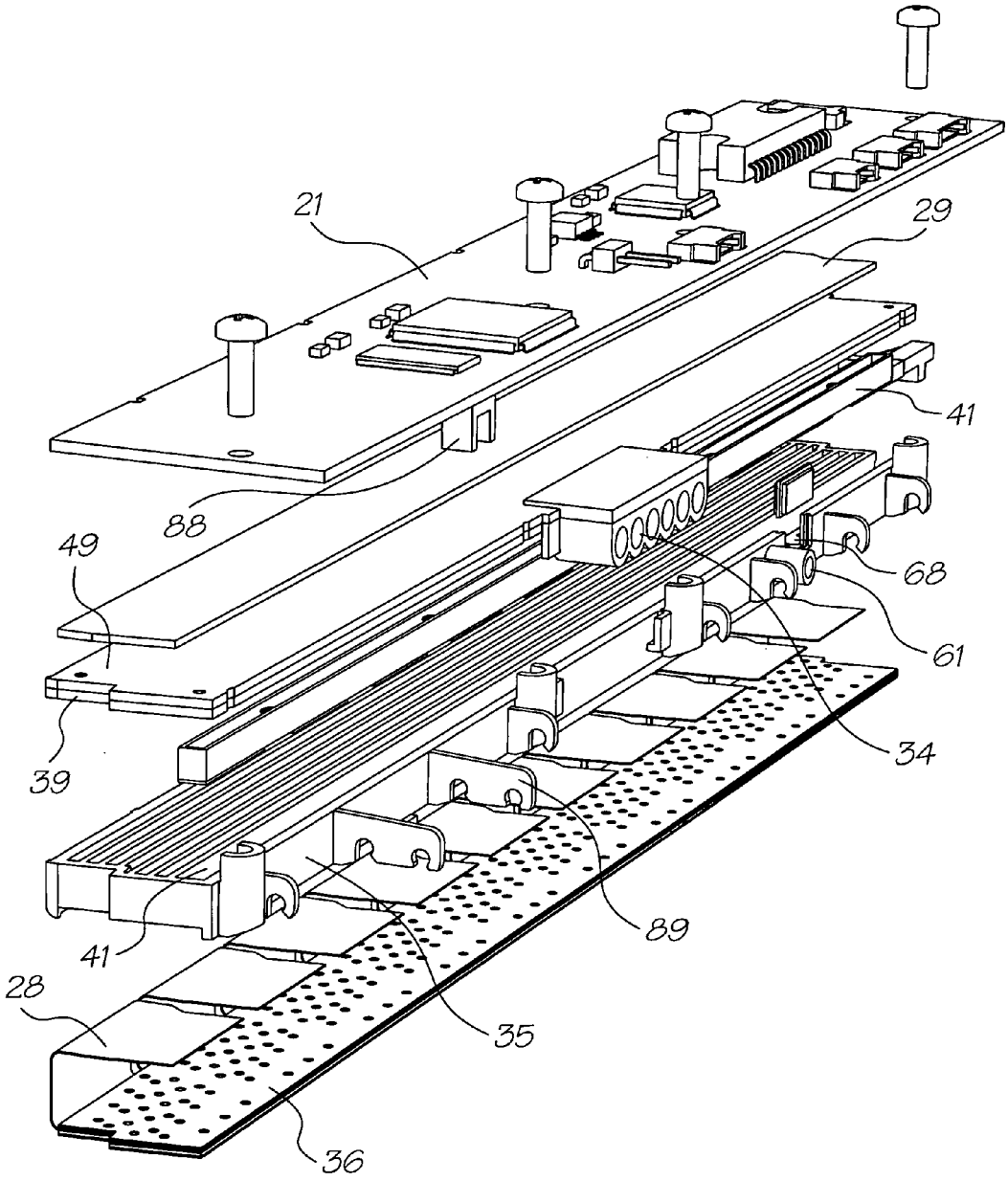
FIG. 6 is an exploded perspective illustration of the printhead assembly.
Figure 8:
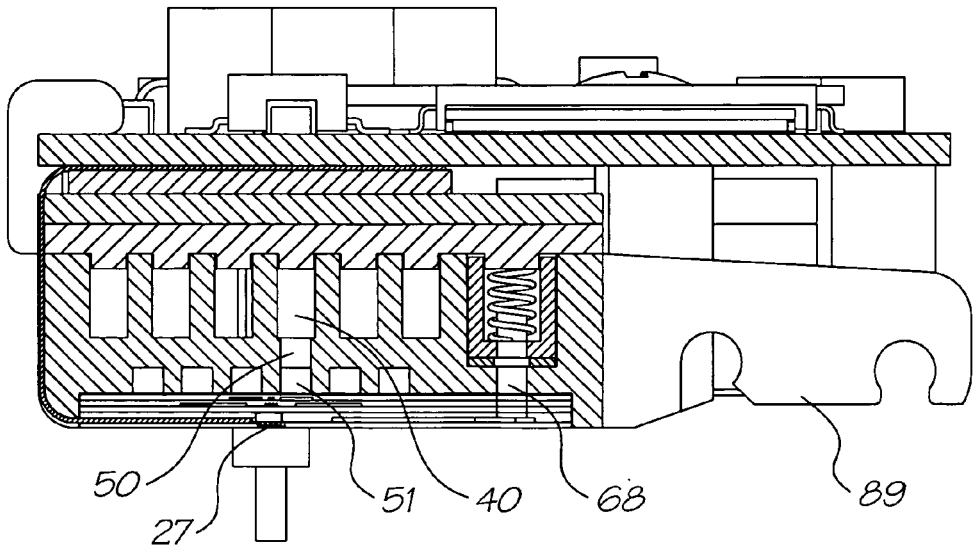
FIG. 8 is a schematic cross-sectional end elevational view of the printhead assembly of FIGS. 4 to 6 taken near the left end of FIG. 4.

With reference to FIGS. 6 to 8, within the air duct 41 of the printhead there is located an air valve molding 66 formed as a channel with a series of apertures 67 in its base. The spacing of these apertures corresponds to air passages 68 formed in the base of the air duct 41 (see FIG. 6), the air valve molding being movable longitudinally within the air duct so that the apertures 67 can be brought into alignment with passages 68 to allow supply the pressurized air through the laminated stack to the cavity between the print chip and the nozzle guard, or moved out of alignment to close off the air supply. Compression springs 69 maintain a sealing inter-engagement of the bottom of the air valve molding 66 with the base of the air duct 41 to prevent leakage when the valve is closed.

The air valve molding 66 has a cam follower 70 extending from one end thereof, which engages an air valve cam surface 71 on an end cap 74 of the platen 14 so as to selectively move the air valve molding longitudinally within the air duct 41 according to the rotational positional of the multi-function platen 14, which may be rotated between printing, capping and blotting positions depending on the operational status of the printer, as will be described below in more detail with reference to FIGS. 21 to 24. When the platen 14 is in its rotational position for printing, the cam holds the air valve in its open position to supply air to the print chip surface, whereas when the platen is rotated to the non-printing position in which it caps off the micro-apertures of the nozzle guard, the cam moves the air valve molding to the valve closed position.

With reference to FIGS. 21 to 24, the platen member 14 extends parallel to the printhead, supported by a rotary shaft 73 mounted in bearing molding 18 and rotatable by means of gear 79 (see FIG. 3). The shaft is provided with a right hand end cap 74 and left hand end cap 75 at respective ends, having cams 76, 77.

The platen member 14 has a platen surface 78, a capping portion 80 and an exposed blotting portion 81 extending along its length, each separated by 120°. During printing, the platen member is rotated so that the platen surface 78 is positioned opposite the printhead so that the platen surface acts as a support for that portion of the paper being printed at the time. When the printer is not in use, the platen member is rotated so that the capping portion 80 contacts the bottom of the printhead, sealing in a locus surrounding the microapertures 44. This, in combination with the closure of the air valve by means of the air valve arrangement when the platen 14 is in its capping position, maintains a closed atmosphere at the print nozzle surface. This serves to reduce evaporation of the ink solvent (usually water) and thus reduce drying of ink on the print nozzles while the printer is not in use.

The third function of the rotary platen member is as an ink blotter to receive ink from priming of the print nozzles at printer start up or maintenance operations of the printer. During this printer mode, the platen member 14 is rotated so that the exposed blotting portion 81 is located in the ink ejection path opposite the nozzle guard 43. The exposed blotting portion 81 is an exposed part of a body of blotting material 82 inside the platen member 14, so that the ink received on the exposed portion 81 is drawn into the body of the platen member.

Figure 23:
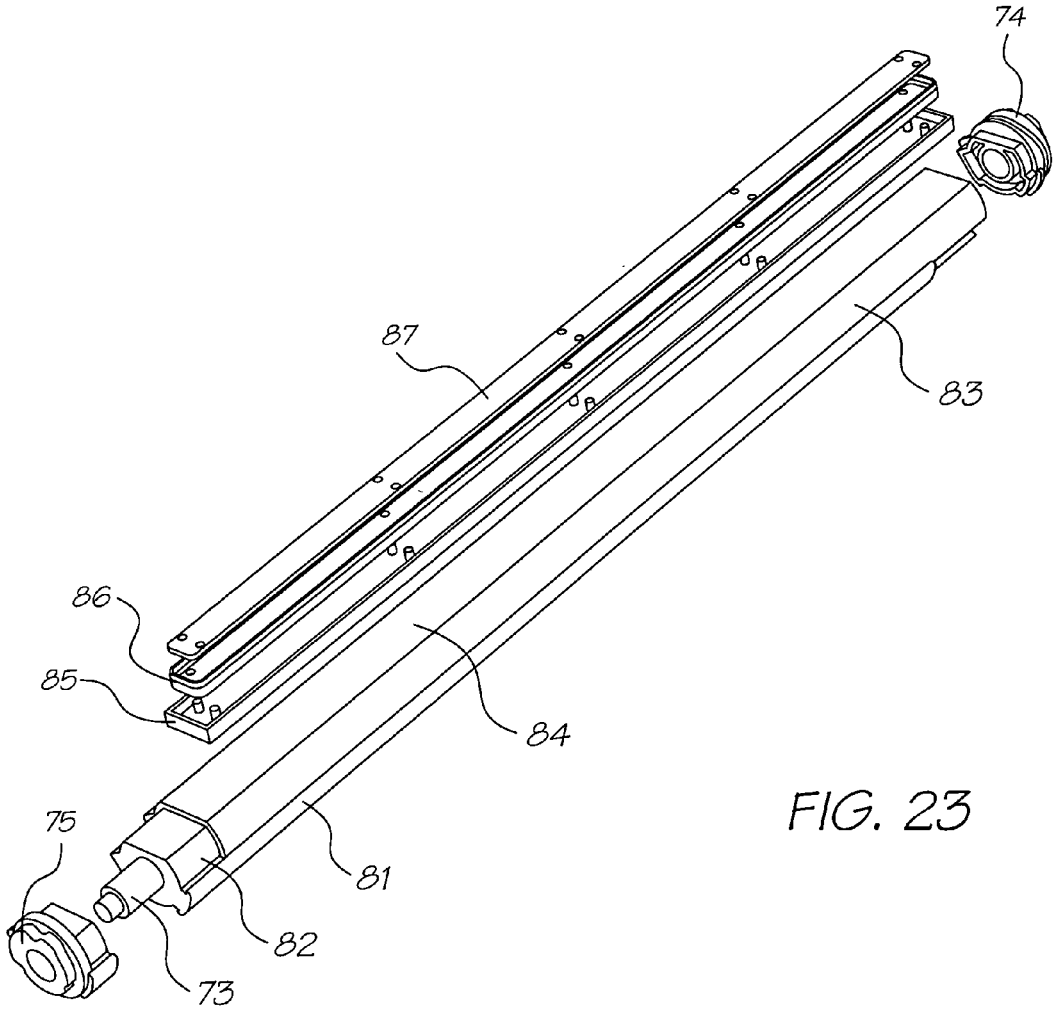
FIG. 23 is an exploded view of the platen.
Figure 24:
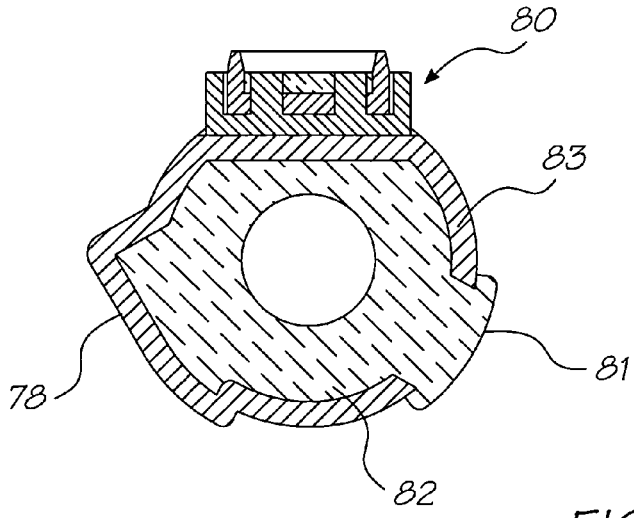
FIG. 24 is a transverse cross-sectional view of the platen.

Further details of the platen member construction may be seen from FIGS. 23 and 24. The platen member consists generally of an extruded or molded hollow platen body 83 which forms the platen surface 78 and receives the shaped body of blotting material 82 of which a part projects through a longitudinal slot in the platen body to form the exposed blotting surface 81. A flat portion 84 of the platen body 83 serves as a base for attachment of the capping member 80, which consists of a capper housing 85, a capper seal member 86 and a foam member 87 for contacting the nozzle guard 43.

With reference again to FIG. 1, each bearing molding 18 rides on a pair of vertical rails 101. That is, the capping assembly is mounted to four vertical rails 101 enabling the assembly to move vertically. A spring 102 under either end of the capping assembly biases the assembly into a raised position, maintaining cams 76,77 in contact with the spacer projections 100.

The printhead 11 is capped when not is use by the full-width capping member 80 using the elastomeric (or similar) seal 86. In order to rotate the platen assembly 14, the main roller drive motor is reversed. This brings a reversing gear into contact with the gear 79 on the end of the platen assembly and rotates it into one of its three functional positions, each separated by 120°.

The cams 76, 77 on the platen end caps 74, 75 co-operate with projections 100 on the respective printhead spacers 20 to control the spacing between the platen member and the printhead depending on the rotary position of the platen member. In this manner, the platen is moved away from the printhead during the transition between platen positions to provide sufficient clearance from the printhead and moved back to the appropriate distances for its respective paper support, capping and blotting functions.

Figure 25:
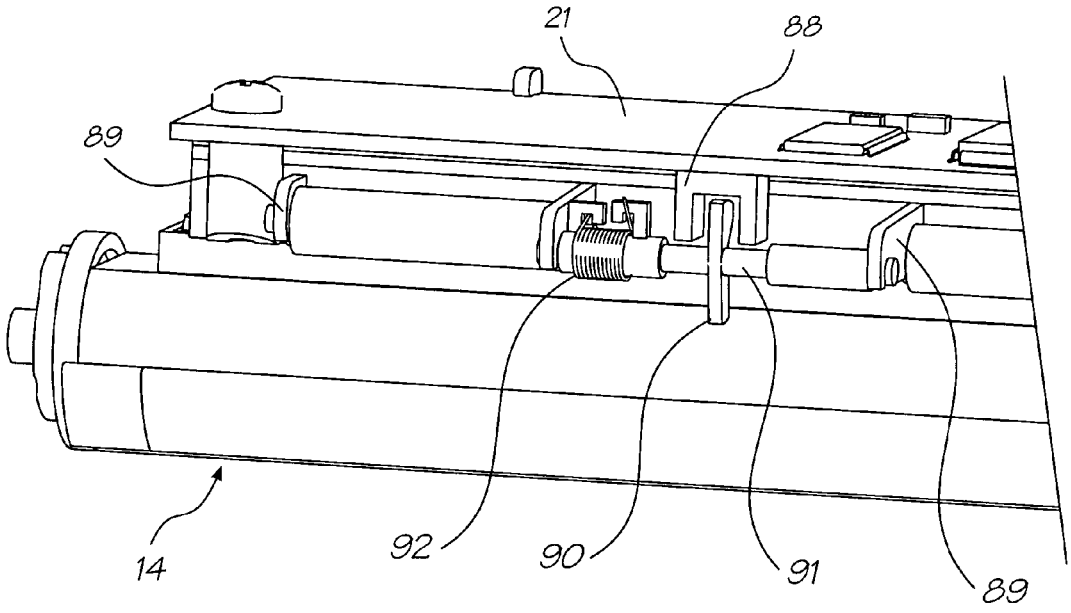
FIG. 25 is a front perspective view of the optical paper sensor arrangement.

In addition, the cam arrangement for the rotary platen provides a mechanism for fine adjustment of the distance between the platen surface and the printer nozzles by slight rotation of the platen 14. This allows compensation of the nozzle-platen distance in response to the thickness of the paper or other material being printed, as detected by the optical paper thickness sensor arrangement illustrated in FIG. 25.

The optical paper sensor includes an optical sensor 88 mounted on the lower surface of the PCB 21 and a sensor flag arrangement mounted on the arms 89 protruding from the distribution molding. The flag arrangement comprises a sensor flag member 90 mounted on a shaft 91 which is biased by torsion spring 92. As paper enters the feed rollers, the lowermost portion of the flag member contacts the paper and rotates against the bias of the spring 92 by an amount dependent on the paper thickness. The optical sensor detects this movement of the flag member and the PCB responds to the detected paper thickness by causing compensatory rotation of the platen 14 to optimize the distance between the paper surface and the nozzles.

Figure 26:
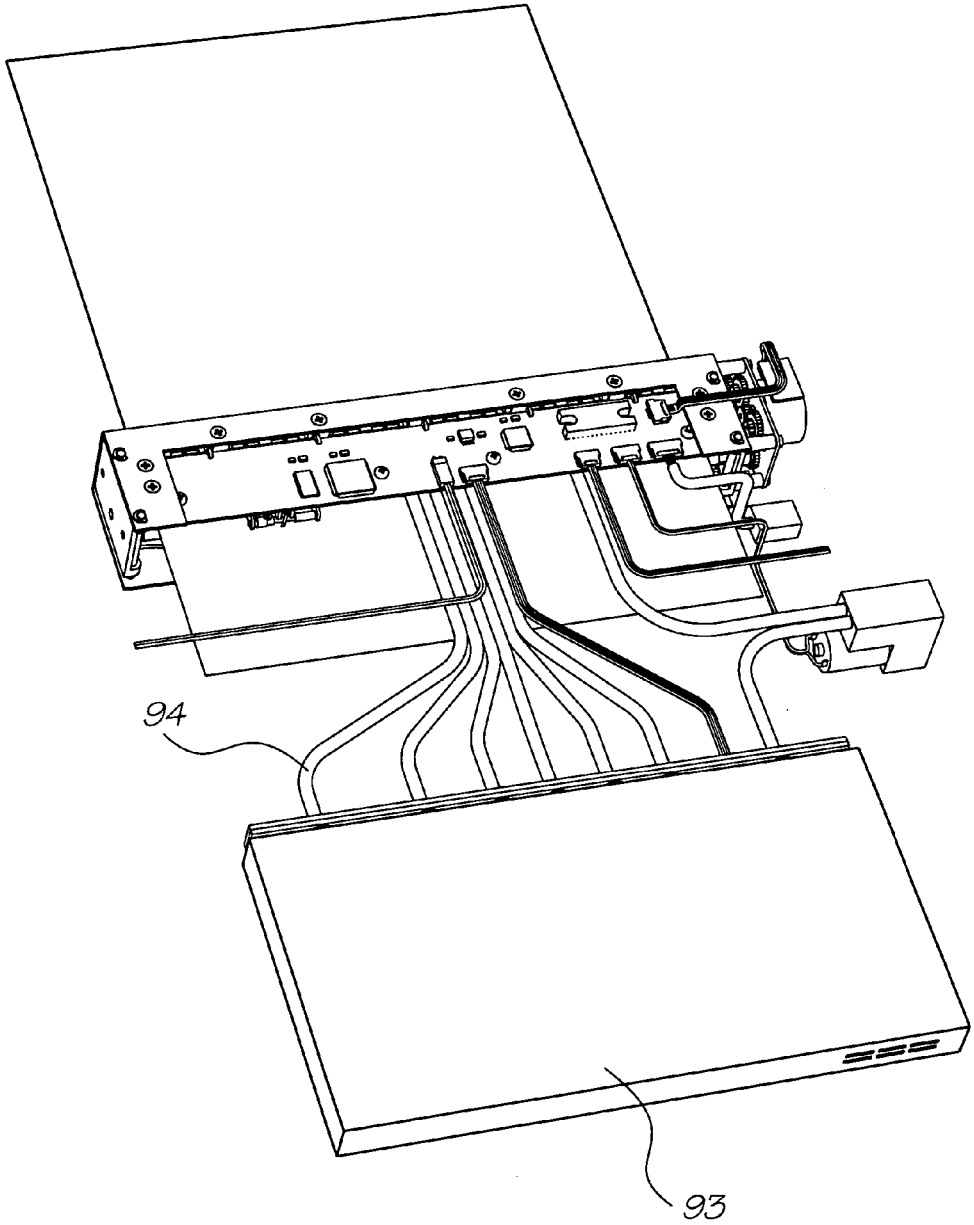
FIG. 26 is a schematic perspective illustration of a printhead assembly and ink lines attached to an ink reservoir cassette.
Figure 27:
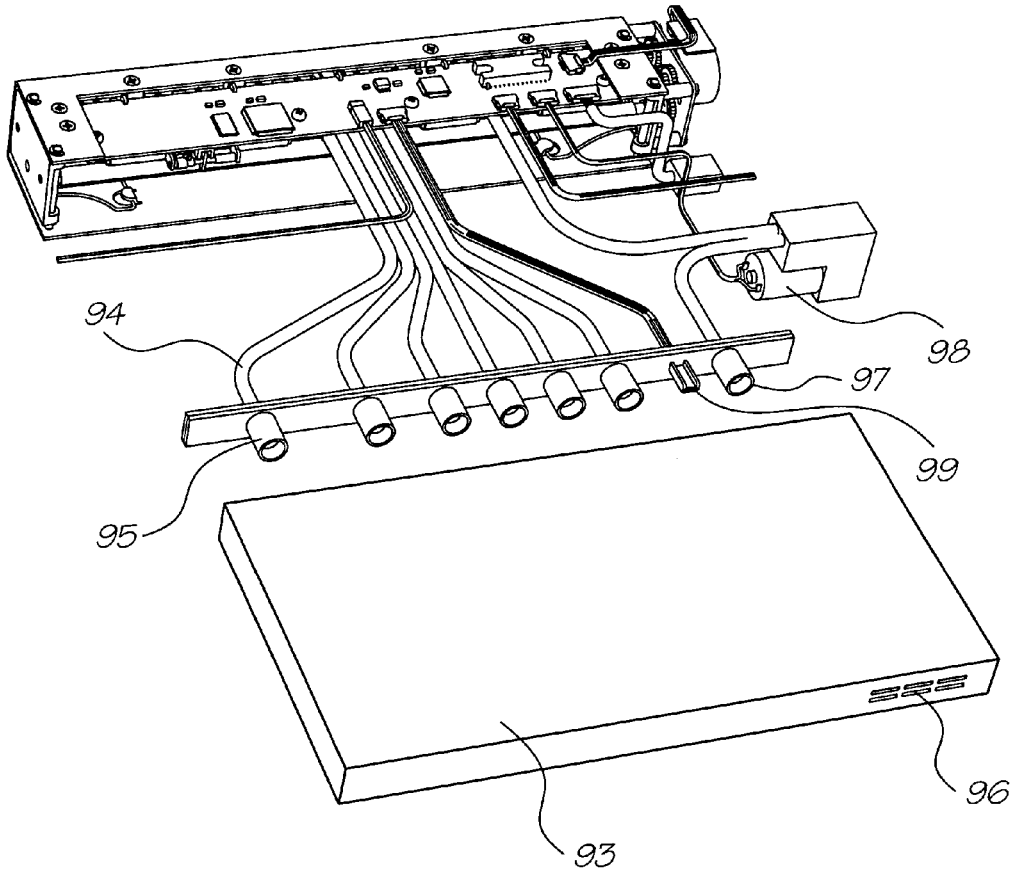
FIG. 27 is a partly exploded view of FIG. 26.

FIGS. 26 and 27 show attachment of the illustrated printhead assembly to a replaceable ink cassette 93. Six different inks are supplied to the printhead through hoses 94 leading from an array of female ink valves 95 located inside the printer body. The replaceable cassette 93 containing a six compartment ink bladder and corresponding male valve array is inserted into the printer and mated to the valves 95. The cassette also contains an air inlet 96 and air filter (not shown), and mates to the air intake connector 97 situated beside the ink valves, leading to the air pump 98 supplying filtered air to the printhead. A QA chip is included in the cassette. The QA chip meets with a contact 99 located between the ink valves 95 and air intake connector 96 in the printer as the cassette is inserted to provide communication to the QA chip connector 24 on the PCB.

In FIGS. 28 to 34 of the accompanying drawings there is schematically depicted portions of abutting print chips 110. Each print chip 110 includes a multitude of unit cells 114, each including a nozzle 115 and an actuator 116. Our co-pending U.S. patent application Ser. Nos.: 09/112,751, 09/112,787, 09/112,802, 09/112,803, 09/113,097, 09/113,099, 09/113,084, 09/113,066, 09/112,778, 09/112,779, 09/113,077, 09/113,061, 09/112,818, 09/112,816, 09/112,772, 09/112,819, 09/112,815, 09/113,096, 09/113,068, 09/113,095, 09/112,808, 09/112,809, 09/112,780, 09/113,083, 09/113,121, 09/113,122, 09/112,793, 09/112,794, 09/113,128, 09/113,127, 09/112,756, 09/112,755, 09/112,754, 09/112,811, 09/112,812, 09/112,813, 09/112,814, 09/112,764, 09/112,765, 09/112,767, 09/112,768, 09/112,807, 09/112,806, 09/112,820, 09/112,821 incorporated herein by reference on page 1 disclose various nozzles and actuators suitable for use in unit cells 114. Each actuator is actuatable upon demand to cause the ejection of ink from the nozzles 115 to be received upon a print medium that passes the print chips 110 in the direction indicated by arrow P.

Typically ten such print chips 110 would be received across the pagewidth of the printing apparatus. For example, with reference to FIG. 12, ten print chips 27 are depicted and with slight modifications to the laminated structure depicted in FIG. 12, the abutting array of print chips of FIGS. 28 to 32 could be employed.

With reference again to FIG. 28, each print chip 110 has end surfaces 111 between which there extends a sequence of angled portions 112 and longitudinally aligned portions 113. Portions 112 and 113 form a "zig-zag" configuration across the print chips between the end portions of end surfaces 111. However, a different profile could be provided.

Figure 28:
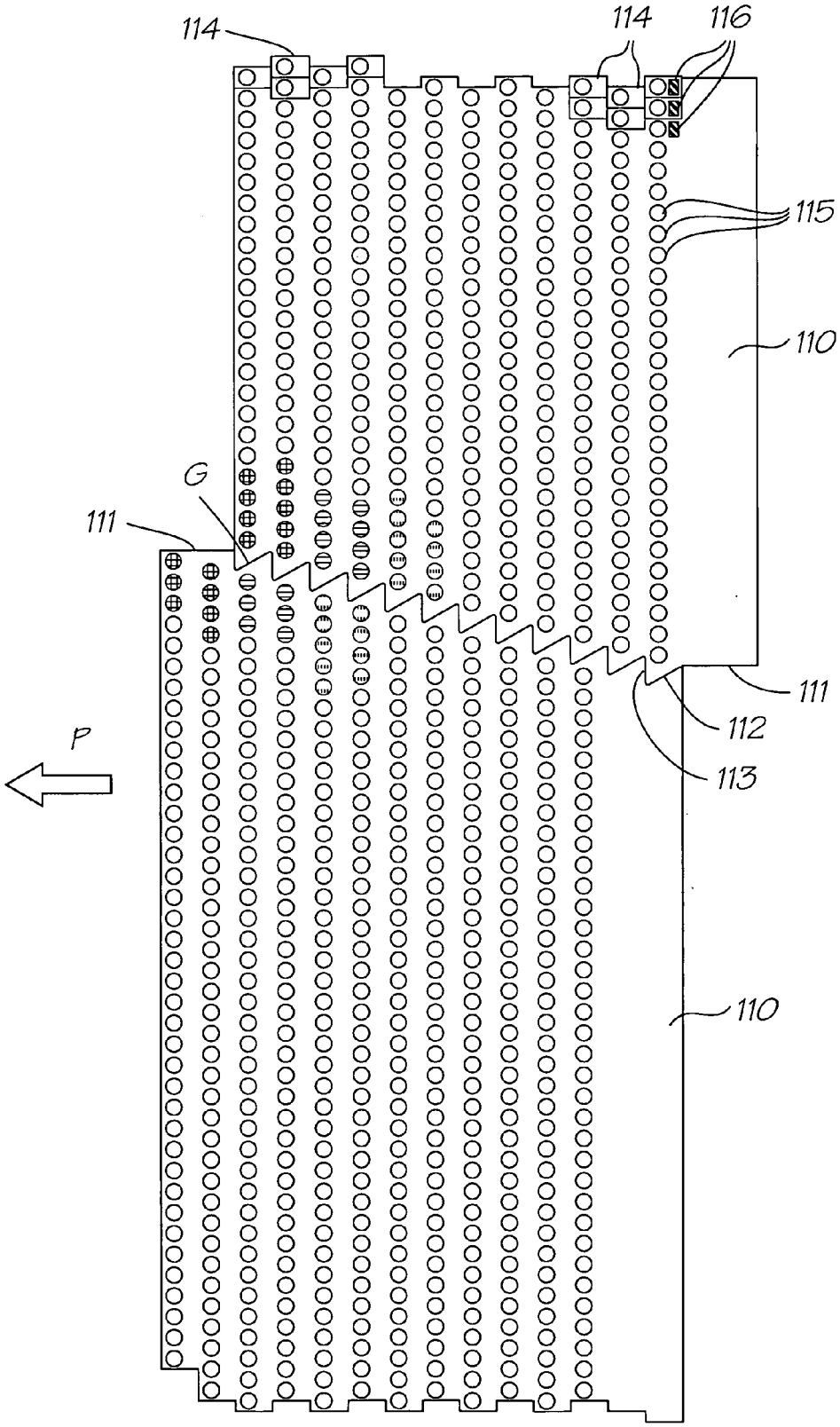
FIG. 28 is a schematic plan view of portions of a pair of print chips in an array of print chips that are abutting end-to-end in a printhead without gaps between the abutting surfaces of the print chips.
Figure 29:
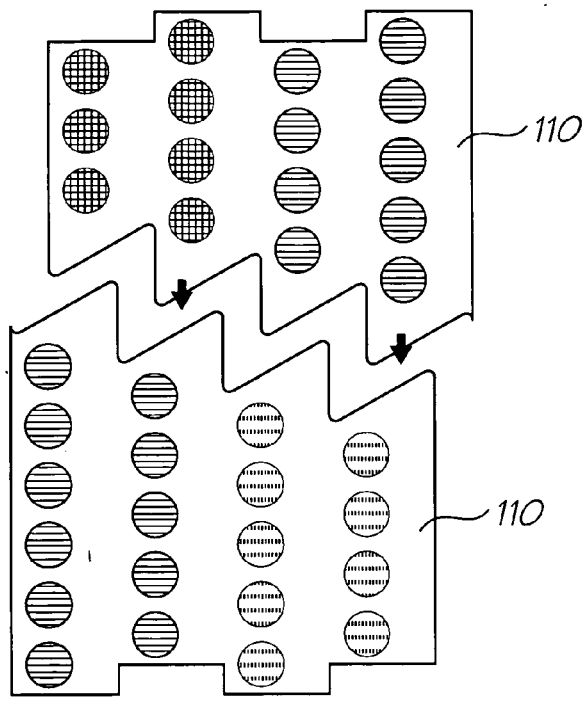
FIG. 29 is a schematic close-up plan view of portions of a pair of print chips about to be abutted together.
Figure 31:
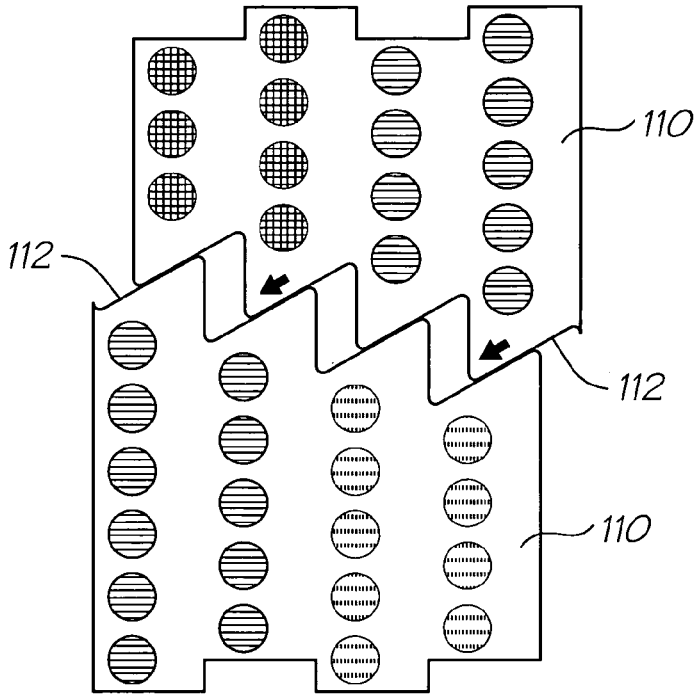
FIG. 31 is a schematic plan view of those portions of the print chips shown in FIG. 29 after having been abutted, but before a sliding motion between the end surfaces has been completed.
Figure 33:
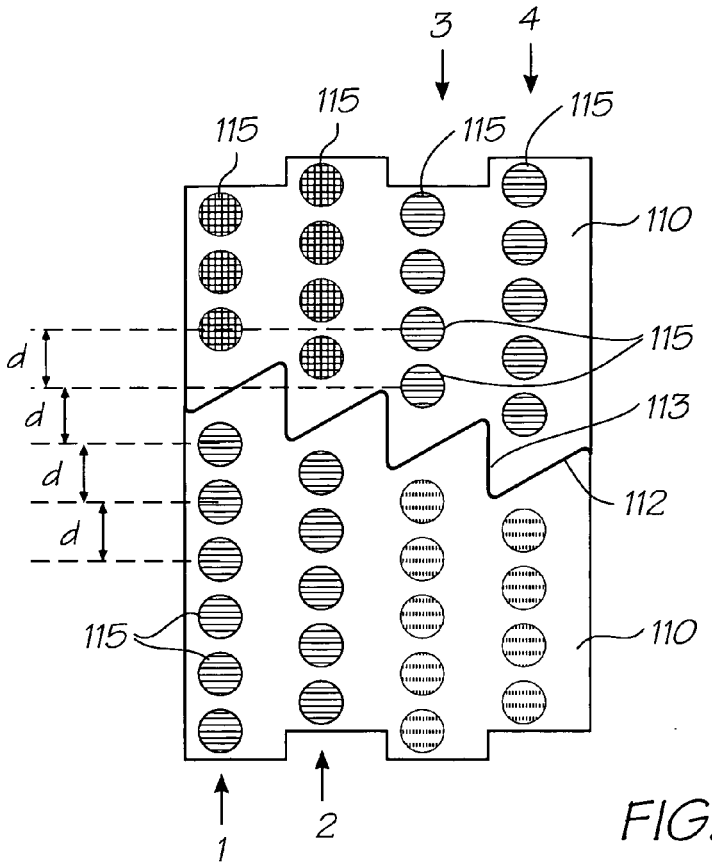
FIG. 33 is a schematic plan view of those portions of the abutting print chips shown in FIGS. 29 to 32, but after the sliding motion has been completed.

If one closely examines the adjoining portions of the print chips 110 in FIG. 28, it can be seen that across each angled portion 112, there is a gap G between the ordinary spacing of the nozzles 115 in which no nozzle is provided. However, examination of FIG. 33 which shows a close-up portion of the abutting print chips reveal that continuity of equal spacing d in the pagewidth direction between nozzles for the same colored ink is maintained across the transition from one chip 110 to the next. In this regard, it should be noted that the key shading provided for each of the nozzles 115 in FIGS. 29, 31 and 33 is intended to indicate that particular nozzles are intended to eject particular colored inks. For example, those rows indicated by the numbers 1, 2, 3, and 4 in FIG. 33 all eject the same colored ink. Although there is a discontinuity in the page length direction at the transition between the abutting chips 110, printer driver software can accommodate for this.

Figure 30:
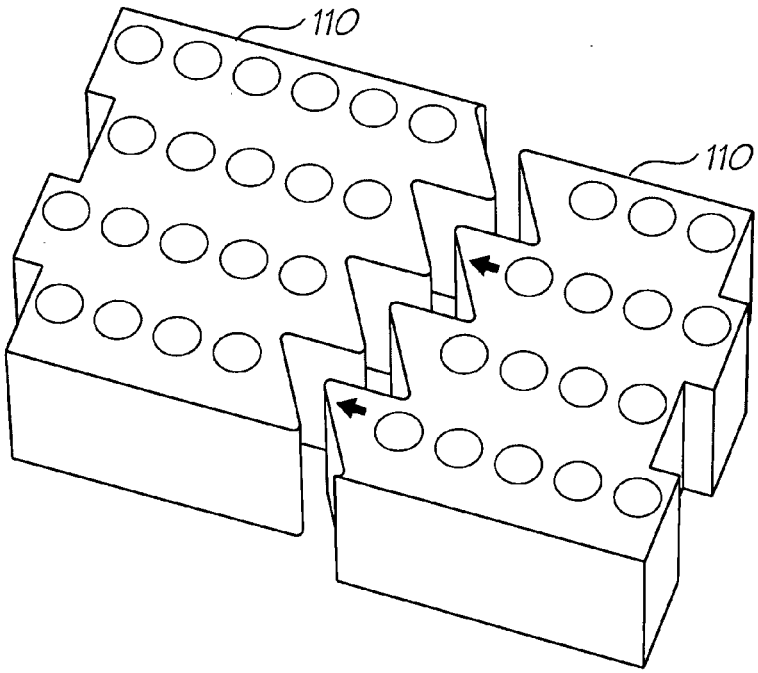
FIG. 30 is a schematic perspective view of what is shown in FIG. 29.
Figure 32:
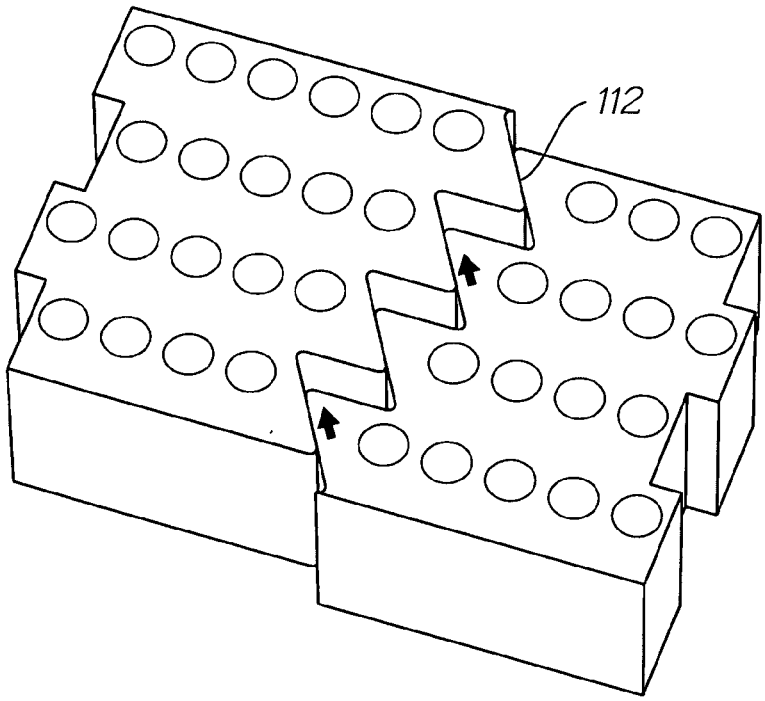
FIG. 32 is a schematic perspective view of what is shown in FIG. 31.

A pagewidth printhead including a number (say ten) of print chips 110 can be assembled by moving the chips toward one another as shown in FIGS. 29 and 30. Once the angled portions 112 have abutted as shown in FIGS. 31 and 32, a sliding motion of about 15 μm between those abutting surfaces will result in the longitudinally aligned portions 113 coming into mutual contact. At this point, the pagewidth-direction spacing d between nozzles 115 is maintained across the transition between the abutting chips 110. The spacing between the nozzles of say row 2 and row 3, is also set to that for which the printer software is designed to operate.

Figure 34:
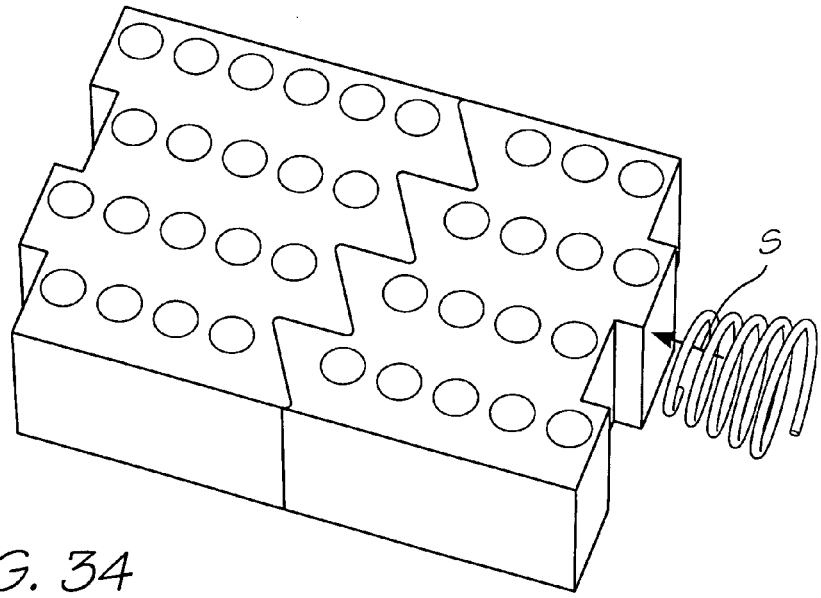
FIG. 34 is a schematic perspective view of what is shown in FIG. 33.

A spring force as indicated schematically at S in FIG. 34 maintains a compression across all of the abutting print chips 110. That is, where ten such chips are provided across the pagewidth of a printhead, a loading spring at one or both ends of the printhead will maintain the force S right through the array of print chips, thus ensuring that a constant force is maintained across the printhead. This is advantageous because it allows the whole row of chips to expand and contract together with fluctuations in ambient or operating temperatures. As the print chips include both plastics and silicone components, no particular complex design consideration need be given to accommodate for the variable rate of thermal expansion of these two materials. Instead, the whole row of print chips 110 can expand and contract slightly, making small and imperceptible variations in print quality.

I claim:

1. A printhead assembly that comprises an elongate ink distribution structure having ink inlets to receive ink and longitudinally extending ink channels in fluid communication with the inlets;

an elongate ink duct assembly mounted on the ink distribution structure and defining a plurality of converging ink ducts with inlets in fluid communication with the ink channels; and a plurality of elongate and serially arranged printhead integrated circuits mounted on the ink duct assembly to receive ink from the ink ducts, each printhead integrated circuit defining mating formations on respective ends to facilitate mating of consecutive printhead integrated circuits.

2. A printhead assembly as claimed in claim 1, wherein the mating formations have a zigzagged plan profile and extend obliquely with respect to a longitudinal axis of each printhead integrated circuit.

3. A printhead assembly as claimed in claim 1, in which a compressing mechanism is interposed between an end integrated circuit and the ink duct assembly for compressing the printhead integrated circuits together.

4. A printhead assembly as claimed in claim 3, wherein the compressing mechanism includes one or more springs.

5. A printhead assembly as claimed in claim 1, wherein each printhead integrated circuit includes a plurality of longitudinally extending printer nozzle rows, the mating formations being configured so that as the mating formations of consecutive integrated circuits contact each other and move into abutment, the respective rows are brought into alignment with each other.

6. A printhead assembly as claimed in claim 1, in which each ink channel of the ink distribution structure is in fluid communication with a respective inlet to receive a particular ink.

7. A printhead assembly as claimed in claim 1, in which the ink duct assembly includes a laminated stack of structural sheets that each define openings and corresponding formations that are oriented to define the ink ducts.

* * * * *